US011045026B2

(12) United States Patent
Sims

(10) Patent No.: US 11,045,026 B2
(45) **Date of Patent: *Jun. 29, 2021**

(54) LOCKABLE BEVERAGE CONTAINER CLOSURE

(71) Applicant: Pacific Market International, LLC, Seattle, WA (US)

(72) Inventor: Randy Sims, Franklin, TN (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/883,841

(22) Filed: May 26, 2020

(65) Prior Publication Data

US 2020/0352370 A1 Nov. 12, 2020

Related U.S. Application Data

(63) Continuation of application No. 15/930,176, filed on May 12, 2020, which is a continuation of application (Continued)

(51) Int. Cl.
*A47G 19/22* (2006.01)
*B65D 41/04* (2006.01)

(Continued)

(52) U.S. Cl.
CPC ..... *A47G 19/2272* (2013.01); *B65D 41/04* (2013.01); *B65D 43/02* (2013.01);

(Continued)

(58) Field of Classification Search
CPC .. A47G 19/2272; B65D 43/165; B65D 43/22; B65D 47/0857; B65D 53/02;

(Continued)

(56) References Cited

U.S. PATENT DOCUMENTS 118,860 A 9/1871 Kent
404,192 A 5/1889 Haas (Continued)

FOREIGN PATENT DOCUMENTS

CN 2198839 Y 5/1995
CN 2210160 Y 10/1995

(Continued)

OTHER PUBLICATIONS

Extended European Search Report dated Jan. 22, 2013, European Patent Application No. 12183461.8, filed Sep. 7, 2012, eight pages.

(Continued)

*Primary Examiner* — Kareen K Thomas
(74) *Attorney, Agent, or Firm* — George C. Rondeau, Jr.; Davis Wright Tremaine, LLP

(57) ABSTRACT

A lid for use with a beverage container. The lid has a body with a drink opening, a drink opening stopper operable to transition between a closed position and an opened position, and a lock actuator manually rotatable between a locking position preventing the drink opening stopper from transitioning from the closed position to the opened position when the lock actuator is in the locking position and an unlocking position permitting the drink opening stopper to transition from the closed position to the opened position when the lock actuator is in the unlocking position.

26 Claims, 25 Drawing Sheets

Related U.S. Application Data

No. 16/047,930, filed on Jul. 27, 2018, now Pat. No. 10,660,463, which is a continuation of application No. 14/959,246, filed on Dec. 4, 2015, now Pat. No. 10,034,564, which is a continuation of application No. 14/321,675, filed on Jul. 1, 2014, now Pat. No. 9,282,838.

(51) Int. Cl.

| | |
|---|---|
| ***B65D 43/02*** | (2006.01) |
| ***B65D 43/26*** | (2006.01) |
| ***B65D 55/02*** | (2006.01) |
| ***B65D 47/08*** | (2006.01) |
| ***B65D 47/32*** | (2006.01) |
| ***B65D 51/18*** | (2006.01) |
| ***B65D 43/16*** | (2006.01) |
| ***B65D 43/22*** | (2006.01) |
| ***B65D 53/02*** | (2006.01) |

(52) U.S. Cl.

CPC ..... *B65D 43/0225* (2013.01); *B65D 43/0229* (2013.01); *B65D 43/165* (2013.01); *B65D 43/22* (2013.01); *B65D 43/26* (2013.01); *B65D 47/0857* (2013.01); *B65D 47/0871* (2013.01); *B65D 47/32* (2013.01); *B65D 51/18* (2013.01); *B65D 53/02* (2013.01); *B65D 55/02* (2013.01); *B65D 2205/02* (2013.01); *B65D 2251/009* (2013.01); *B65D 2251/0015* (2013.01); *B65D 2251/0018* (2013.01); *B65D 2251/0021* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01); *B65D 2543/0049* (2013.01); *B65D 2543/00092* (2013.01); *B65D 2543/00231* (2013.01); *B65D 2543/00546* (2013.01); *B65D 2543/00972* (2013.01)

(58) Field of Classification Search

CPC ..... B65D 43/0225; B65D 51/18; B65D 43/0229; B65D 47/0871; B65D 47/32; B65D 41/04; B65D 43/02; B65D 43/26; B65D 55/02; B65D 2251/0021; B65D 2251/0025; B65D 2251/0087; B65D 2251/0028; B65D 2251/0081; B65D 2251/009; B65D 2205/02; B65D 2543/00092; B65D 2543/00231; B65D 2543/0049; B65D 2543/00546; B65D 2543/00972; B65D 2251/0015; B65D 2251/0018; B65D 2543/00046

See application file for complete search history.

(56) References Cited

U.S. PATENT DOCUMENTS

| | | | |
|---|---|---|---|
| 421,282 | A | 2/1890 | Jackson |
| 599,389 | A | 2/1898 | Jackson |
| 656,000 | A | 8/1900 | Wall |
| 657,636 | A | 9/1900 | Bingham |
| 768,355 | A | 8/1904 | Bolen |
| 830,142 | A | 9/1906 | Ebbing |
| 1,072,588 | A | 9/1913 | Duncan |
| 1,284,728 | A | 11/1918 | Wahl et al. |
| 1,311,373 | A | 7/1919 | Barr |
| 1,316,949 | A | 9/1919 | Gilbert et al. |
| 1,322,669 | A | 11/1919 | Shepard et al. |
| 2,138,387 | A | 11/1938 | Officer |
| 2,193,232 | A | 3/1940 | Hacmac |
| 2,210,206 | A | 8/1940 | Fisher |
| 2,274,849 | A | 3/1942 | Peterson |
| 2,447,870 | A | 8/1948 | Polcyn |
| 2,622,420 | A | 12/1952 | Rice |
| 2,799,437 | A | 7/1957 | Jepson |
| 2,884,157 | A | 4/1959 | Lampkin |
| 3,050,219 | A | 8/1962 | Sagarin |
| 3,059,816 | A | 10/1962 | Goldstein |
| 3,096,897 | A | 7/1963 | Hansen |
| 3,185,350 | A | 5/1965 | Abplanalp |
| 3,308,835 | A | 3/1967 | Silverberg |
| 3,325,054 | A | 6/1967 | Braun |
| 3,422,996 | A | 1/1969 | Lipman |
| 3,591,128 | A | 7/1971 | Ramis |
| 3,635,380 | A | 1/1972 | Fitzgerald |
| 3,722,748 | A | 3/1973 | Wakeman et al. |
| 3,739,938 | A | 6/1973 | Paz |
| 3,744,682 | A | 7/1973 | Blank |
| 3,770,167 | A | 11/1973 | Ewald |
| 3,964,631 | A | 6/1976 | Albert |
| 3,967,748 | A | 7/1976 | Albert |
| 3,972,443 | A | 8/1976 | Albert |
| 4,057,167 | A | 11/1977 | Lee |
| 4,065,036 | A | 12/1977 | Kirk, Jr. |
| 4,094,433 | A | 6/1978 | Numbers |
| 4,099,642 | A | 7/1978 | Nergard |
| 4,127,221 | A | 11/1978 | Vere |
| 4,133,446 | A | 1/1979 | Albert |
| 4,136,799 | A | 1/1979 | Albert |
| 4,171,060 | A | 10/1979 | Howard et al. |
| 4,203,527 | A | 5/1980 | LaChance, Sr. |
| 4,212,408 | A | 7/1980 | Valenzona |
| 4,276,992 | A | 7/1981 | Susich |
| 4,303,173 | A | 12/1981 | Nergard |
| 4,676,411 | A | 6/1987 | Simasaki |
| 4,686,725 | A | 8/1987 | Mitchell |
| 4,706,313 | A | 11/1987 | Murphy |
| 4,711,372 | A | 12/1987 | Gach |
| 4,712,704 | A | 12/1987 | Ramsey et al. |
| 4,779,766 | A | 10/1988 | Kinsley |
| 4,801,053 | A | 1/1989 | Kaster |
| 4,834,270 | A | 5/1989 | Messner |
| 4,852,770 | A | 8/1989 | Sledge et al. |
| 4,865,228 | A | 9/1989 | Landecker |
| 4,881,668 | A | 11/1989 | Kitterman et al. |
| 4,901,387 | A | 2/1990 | Luke |
| 5,025,519 | A | 6/1991 | Spann et al. |
| 5,039,158 | A | 8/1991 | Maier |
| 5,070,560 | A | 12/1991 | Wilkinson |
| 5,082,134 | A | 1/1992 | Ramsey |
| 5,118,014 | A | 6/1992 | Hestehave et al. |
| 5,153,977 | A | 10/1992 | Toida et al. |
| 5,163,196 | A | 11/1992 | Graebe et al. |
| 5,167,016 | A | 11/1992 | Bagley et al. |
| 5,169,016 | A | 12/1992 | Hinz, Jr. |
| 5,179,742 | A | 1/1993 | Oberle |
| 5,186,353 | A | 2/1993 | Ramsey |
| 5,199,597 | A | 4/1993 | Gladish |
| 5,222,623 | A | 6/1993 | Eger et al. |
| 5,244,113 | A | 9/1993 | Stymiest |
| 5,249,703 | A | 10/1993 | Karp |
| 5,252,278 | A | 10/1993 | Spann et al. |
| 5,307,950 | A | 5/1994 | Li |
| 5,412,821 | A | 5/1995 | Wilkinson |
| 5,427,271 | A | 6/1995 | Wang |
| 5,461,741 | A | 10/1995 | Graebe |
| 5,462,185 | A | 10/1995 | Walker, III |
| 5,465,866 | A | 11/1995 | Belcastro |
| 5,477,980 | A | 12/1995 | Chaffin |
| 5,485,938 | A | 1/1996 | Boersma |
| 5,495,966 | A | 3/1996 | Won |
| 5,570,797 | A | 11/1996 | Yeh |
| 5,573,139 | A | 11/1996 | Yeh |
| 5,580,504 | A | 12/1996 | Spann et al. |
| 5,586,346 | A | 12/1996 | Stacy et al. |
| 5,596,781 | A | 1/1997 | Graebe |
| 5,606,754 | A | 3/1997 | Hand et al. |
| 5,615,808 | A | 4/1997 | Huang |
| 5,630,238 | A | 5/1997 | Weismiller et al. |
| 5,649,331 | A | 7/1997 | Wilkinson et al. |

(56) References Cited

U.S. PATENT DOCUMENTS 5,652,985 A 8/1997 Wilkinson et al.
5,666,681 A 9/1997 Meyer et al.
5,680,951 A 10/1997 Feltman, III et al.
5,689,845 A 11/1997 Sobieralski
5,711,452 A 1/1998 Chaffin
5,738,236 A 4/1998 Brun, Jr.
5,753,289 A 5/1998 Ness
5,845,352 A 12/1998 Matsler et al.
5,873,476 A 2/1999 Takahashi et al.
5,918,854 A 7/1999 Barrash et al.
5,944,235 A 8/1999 Won
5,987,668 A 11/1999 Ackley
6,003,711 A 12/1999 Bilewitz
6,010,029 A 1/2000 Wang
6,036,271 A 3/2000 Wilkinson et al.
6,053,474 A 4/2000 Stucke, Jr. et al.
6,098,834 A 8/2000 Matsumoto et al.
6,102,244 A 8/2000 Kuwano et al.
6,116,476 A 9/2000 Huang
6,119,291 A 9/2000 Osborne et al.
6,126,035 A 10/2000 Schaper et al.
6,158,608 A 12/2000 Schlattl
RE37,016 E 1/2001 Morano
6,223,369 B1 5/2001 Maier et al.
6,276,560 B1 8/2001 Belcastro
6,324,709 B1 12/2001 Ikeda et al.
6,351,863 B1 3/2002 Meyer et al.
6,352,166 B1 3/2002 Copeland
6,401,990 B1 6/2002 Walters et al.
6,443,325 B1 9/2002 Schaper et al.
6,471,085 B1 10/2002 Gallo
6,557,717 B1 5/2003 Keck
6,601,735 B2 8/2003 Milian et al.
6,623,080 B2 9/2003 Clapper
6,626,314 B1 9/2003 McHenry et al.
6,644,490 B2 11/2003 Clarke
6,679,397 B2 1/2004 Smith et al.
6,695,171 B2 2/2004 Walters et al.
6,701,556 B2 3/2004 Romano et al.
6,702,137 B1 3/2004 Kowa et al.
6,732,875 B2 5/2004 Smith et al.
6,732,876 B2 5/2004 Belcastro
6,732,964 B2 5/2004 Couchey
6,763,964 B1 7/2004 Hurlbut et al.
6,782,574 B2 8/2004 Totton et al.
6,824,003 B1 11/2004 Wong
6,834,769 B2 12/2004 Takahashi et al.
6,854,615 B2 2/2005 von Ronn et al.
6,874,185 B1 4/2005 Phillips et al.
6,901,617 B2 6/2005 Sprouse, II et al.
6,922,863 B2 8/2005 Giori et al.
6,928,681 B1 8/2005 Stacy
6,935,536 B2 8/2005 Tardif
6,952,852 B2 10/2005 Reeder et al.
6,976,281 B2 12/2005 Schunk et al.
6,978,910 B2 12/2005 Sanders et al.
7,011,227 B2 3/2006 Ward et al.
7,073,678 B1 7/2006 Dibdin
7,086,107 B2 8/2006 Ellis et al.
7,195,137 B2 3/2007 Belcastro
7,201,288 B2 4/2007 von Ronn et al.
7,229,134 B2 6/2007 Ito
7,275,653 B2 10/2007 Tedford, Jr.
7,413,096 B2 8/2008 Morgan et al.
7,513,380 B2 4/2009 Canedo
7,546,933 B2 6/2009 Pinelli
7,611,024 B2 * 11/2009 Yamanaka ..... B65D 47/0814 215/237
7,611,029 B2 11/2009 Wong
7,997,442 B2 8/2011 Pinelli
8,056,745 B2 * 11/2011 Yu ..... B65D 47/32 215/359
8,141,731 B2 3/2012 Mazurkiewicz et al.
8,297,462 B1 10/2012 Joyce
8,360,258 B2 1/2013 Gilbert et al.
8,360,267 B1 1/2013 Chiou et al.
8,376,162 B2 2/2013 Yang
8,403,173 B2 3/2013 Wahl et al.
8,418,992 B2 4/2013 Meyer et al.
8,459,510 B2 6/2013 Richards et al.
8,464,895 B2 6/2013 Gilbert et al.
8,540,121 B2 * 9/2013 Walters ..... B65D 83/206 222/182
8,573,431 B2 11/2013 Shepard et al.
8,596,493 B2 * 12/2013 Vollers ..... B65D 47/0838 220/833
8,622,229 B2 1/2014 Lane
8,727,176 B2 5/2014 El-Saden et al.
8,746,496 B2 6/2014 Gilbert et al.
8,844,762 B2 9/2014 Chiou et al.
8,863,979 B2 10/2014 El-Saden et al.
8,978,923 B2 3/2015 George
8,985,370 B2 * 3/2015 Lane ..... B65D 43/26 220/254.5
9,113,698 B2 8/2015 Blain et al.
9,211,040 B2 * 12/2015 Lane ..... B65D 43/22
9,282,838 B2 3/2016 Sims
9,375,107 B2 6/2016 Gilbert et al.
9,462,904 B2 10/2016 Coon et al.
9,808,101 B2 11/2017 Chiou et al.
9,878,832 B2 1/2018 Sims
9,908,687 B2 3/2018 Chiou et al.
10,023,366 B2 7/2018 Gilbert et al.
10,034,564 B2 7/2018 Sims
10,035,629 B2 7/2018 Gilbert et al.
10,071,838 B2 9/2018 Gilbert et al.
10,077,144 B2 9/2018 Gilbert et al.
10,104,993 B2 10/2018 El-Saden et al.
2002/0033400 A1 3/2002 Rohrer et al.
2002/0170874 A1 * 11/2002 Hou ..... A47G 19/2266 215/229
2003/0071041 A1 4/2003 Vogel
2003/0102338 A1 6/2003 Martin
2004/0040962 A1 3/2004 Bielecki et al.
2004/0217139 A1 11/2004 Roth et al.
2005/0023285 A1 2/2005 Keung
2005/0028289 A1 2/2005 Hakarniun
2005/0029265 A1 2/2005 Morgan et al.
2006/0043091 A1 3/2006 Pinelli et al.
2006/0081633 A1 4/2006 Schmidtner et al.
2006/0096983 A1 5/2006 Patterson
2006/0113327 A1 6/2006 Walters et al.
2006/0175331 A1 8/2006 Lin et al.
2006/0226160 A1 10/2006 Elsaden et al.
2007/0170184 A1 7/2007 Canedo
2007/0210093 A1 * 9/2007 Pinelli ..... B65D 43/26 220/715
2007/0241134 A1 10/2007 Gurrisi et al.
2008/0156817 A1 7/2008 Roseblade et al.
2008/0237233 A1 10/2008 Choi et al.
2008/0272134 A1 11/2008 Rohe
2009/0255958 A1 10/2009 Santoni et al.
2010/0206835 A1 8/2010 Yu
2011/0132908 A1 6/2011 Meehan
2011/0309095 A1 12/2011 Pinelli
2012/0145713 A1 * 6/2012 Jung ..... A47J 41/0011 220/254.3
2012/0261416 A1 10/2012 Lin
2012/0285961 A1 * 11/2012 Roth ..... B65D 81/3869 220/254.3
2012/0312832 A1 12/2012 Lane
2013/0119060 A1 * 5/2013 Chiou ..... B65D 43/267 220/254.3
2013/0140309 A1 6/2013 George
2013/0319966 A1 * 12/2013 Lane ..... A45F 3/18 215/237
2014/0197170 A1 7/2014 Carlile et al.
2016/0198878 A1 7/2016 Gilbert et al.
2016/0255973 A1 9/2016 Joseph et al.
2016/0264308 A1 9/2016 Gilbert et al.
2016/0264309 A1 9/2016 Gilbert et al.
2016/0264310 A1 9/2016 Gilbert et al.
2016/0264311 A1 9/2016 Gilbert et al.

(56) References Cited

U.S. PATENT DOCUMENTS

| | | | |
|---|---|---|---|
| 2017/0029182 | A1 | 2/2017 | Coon et al. |
| 2017/0101231 | A1 | 4/2017 | George |
| 2017/0225846 | A1 | 8/2017 | Gilbert et al. |
| 2018/0222641 | A1 | 8/2018 | Gilbert et al. |

FOREIGN PATENT DOCUMENTS

| | | | |
|---|---|---|---|
| CN | 1245766 | A | 3/2000 |
| CN | 1299317 | A | 6/2001 |
| CN | 1345682 | A | 4/2002 |
| CN | 1432512 | A | 7/2003 |
| CN | 1636835 | A | 7/2005 |
| CN | 2866364 | Y | 2/2007 |
| DE | 3402894 | A1 | 8/1985 |
| DE | 20003371 | U1 | 4/2000 |
| DE | 202011002273 | U1 | 4/2011 |
| EP | 1182147 | A2 | 2/2002 |
| JP | S55027429 | A | 2/1980 |
| JP | S58043329 | A | 3/1983 |
| JP | S62131622 | U | 8/1987 |
| JP | H9150852 | A | 6/1997 |
| JP | H11001258 | A | 1/1999 |
| JP | 2005193944 | A | 7/2005 |
| JP | 2005278855 | A | 10/2005 |
| JP | 2009279332 | A | 12/2009 |
| JP | 3171259 | U | 10/2011 |
| KR | 2019980061202 | | 11/1998 |
| WO | 0034143 | A1 | 6/2000 |
| WO | 2000045684 | A1 | 8/2000 |
| WO | 2005115204 | A1 | 12/2005 |
| WO | 2010085367 | A1 | 7/2010 |

OTHER PUBLICATIONS

Extended European Search Report dated Mar. 18, 2013, European Patent Application No. 12195654.4, filed Dec. 5, 2012, seven pages.

Extended European Search Report dated Oct. 18, 2012, European Patent Application No. 12173632.6, four pages.

International Preliminary Report on Patentability for related International Application No. PCT/US2012/064801, dated May 20, 2014.

International Search Report and Written Opinion dated May 21, 2012, International Patent Application No. PCT/US2011/060042, 13 pages.

* cited by examiner

LOCKABLE BEVERAGE CONTAINER CLOSURE

BACKGROUND

Field of the Invention

The present invention is directed generally to lids for liquid storage vessels such as for beverage or food containers and more particularly to lids with movable components and that include a plurality of locking mechanisms.

Description of the Related Art

Prior art lids are typically of one of three types. The first type is a solid unitary lid that does not include openings or apertures through which the contents of a liquid storage vessel may exit the vessel. To drink from the vessel, a user must remove the lid. The second type, which may also be of a unitary construction, includes one or more unobstructed apertures in the lid through which the liquid may exit the vessel. In the second type, the apertures are always open. If the vessel is inadvertently tipped or dropped, the contents of the vessel may spill. The third type of lid includes one or more apertures in the lid through which the liquid may exit the vessel and a means for selectively opening and closing the apertures. When using the third type of lid, the user may selectively open the apertures to remove the contents from the vessel and selectively close the apertures to maintain the contents inside the vessel. Further, by closing the apertures, the lid may help insulate the contents from the environment outside the vessel.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments of the present invention are directed to a lid or a closure for a beverage container that is adapted for closing an open end of the beverage container and isolating the contents of the beverage container from an outside environment. The lid is selectively couplable to the beverage container and is operable to permit the passage of fluid or another substance from the beverage container to an external environment (for example, to be drunk by a person).

Figure 1:
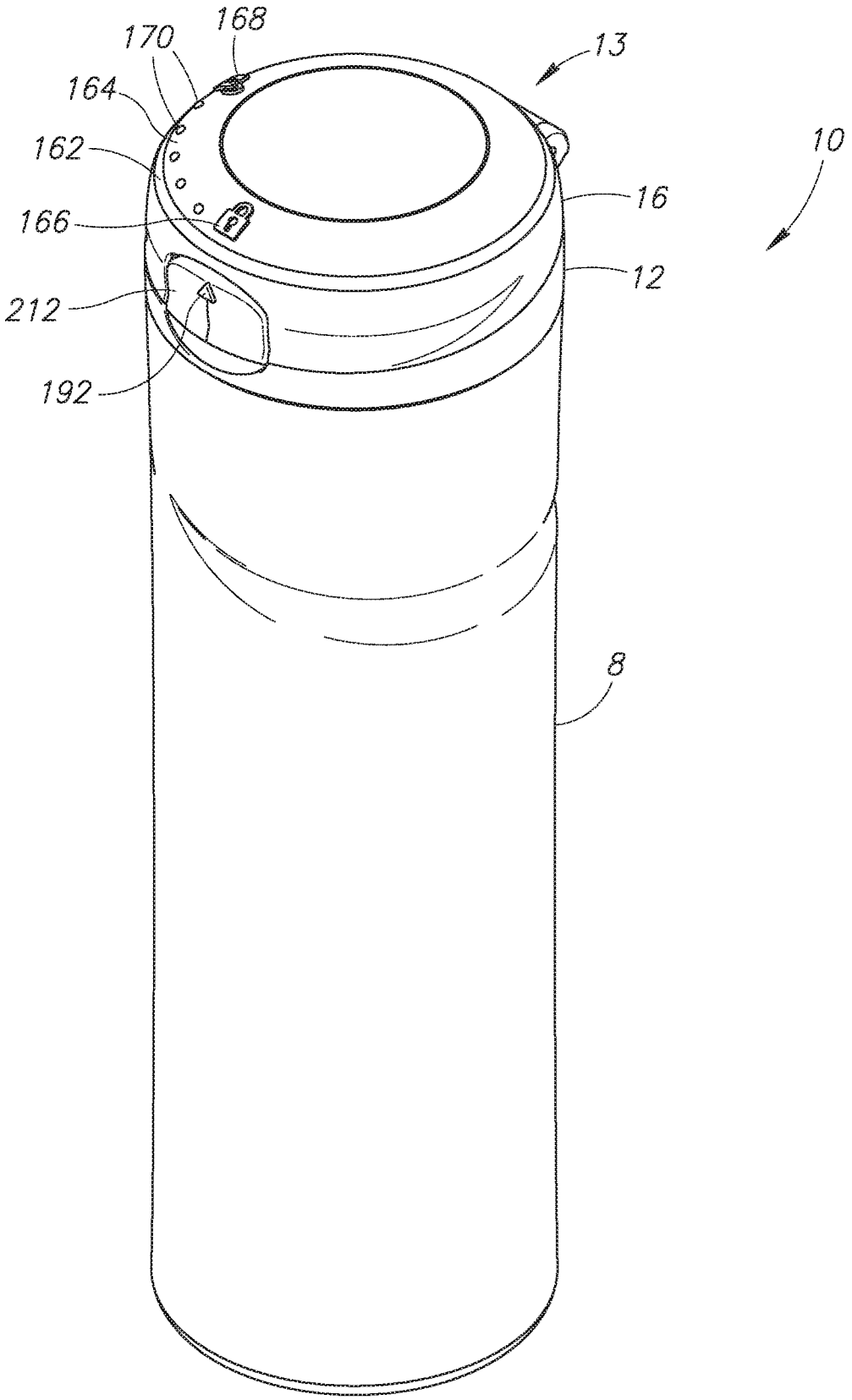
FIG. 1 illustrates a top left side perspective view of a lockable beverage container closure and beverage container according to an embodiment.
Figure 2:
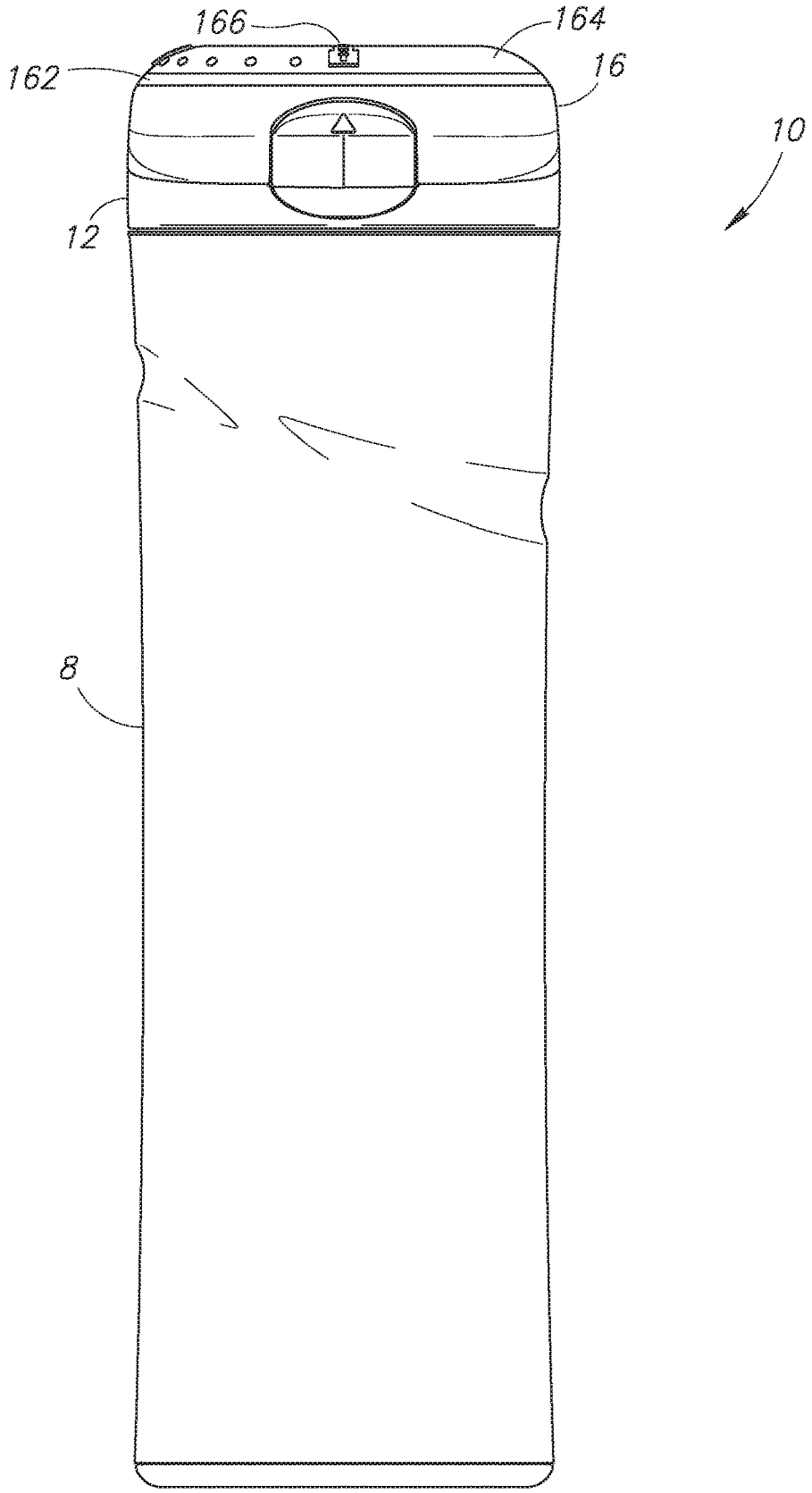
FIG. 2 illustrates a front elevational view of the lockable beverage container closure and beverage container.
Figure 3:
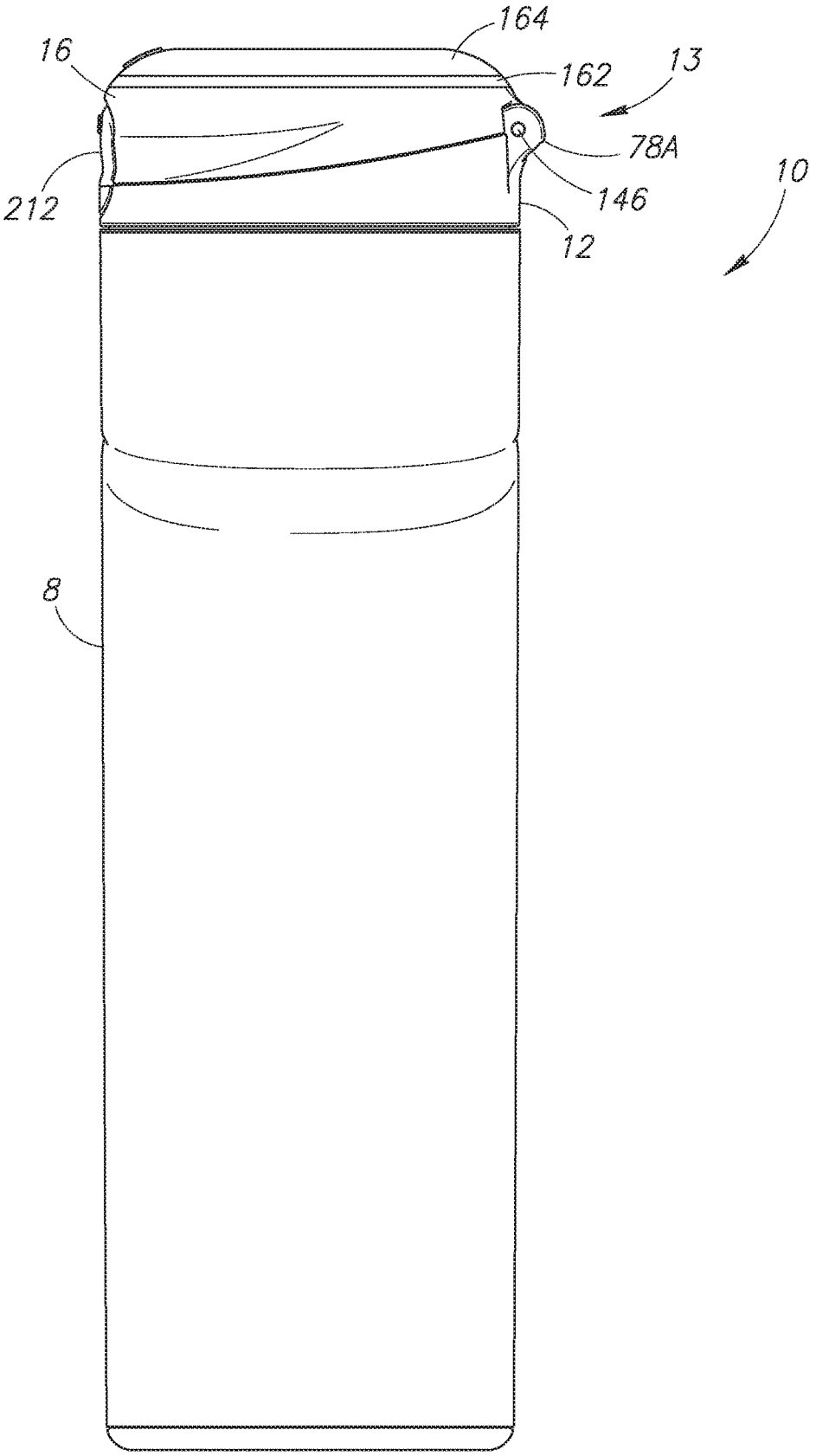
FIG. 3 illustrates a left side elevational view of the lockable beverage container closure and beverage container.
Figure 4:
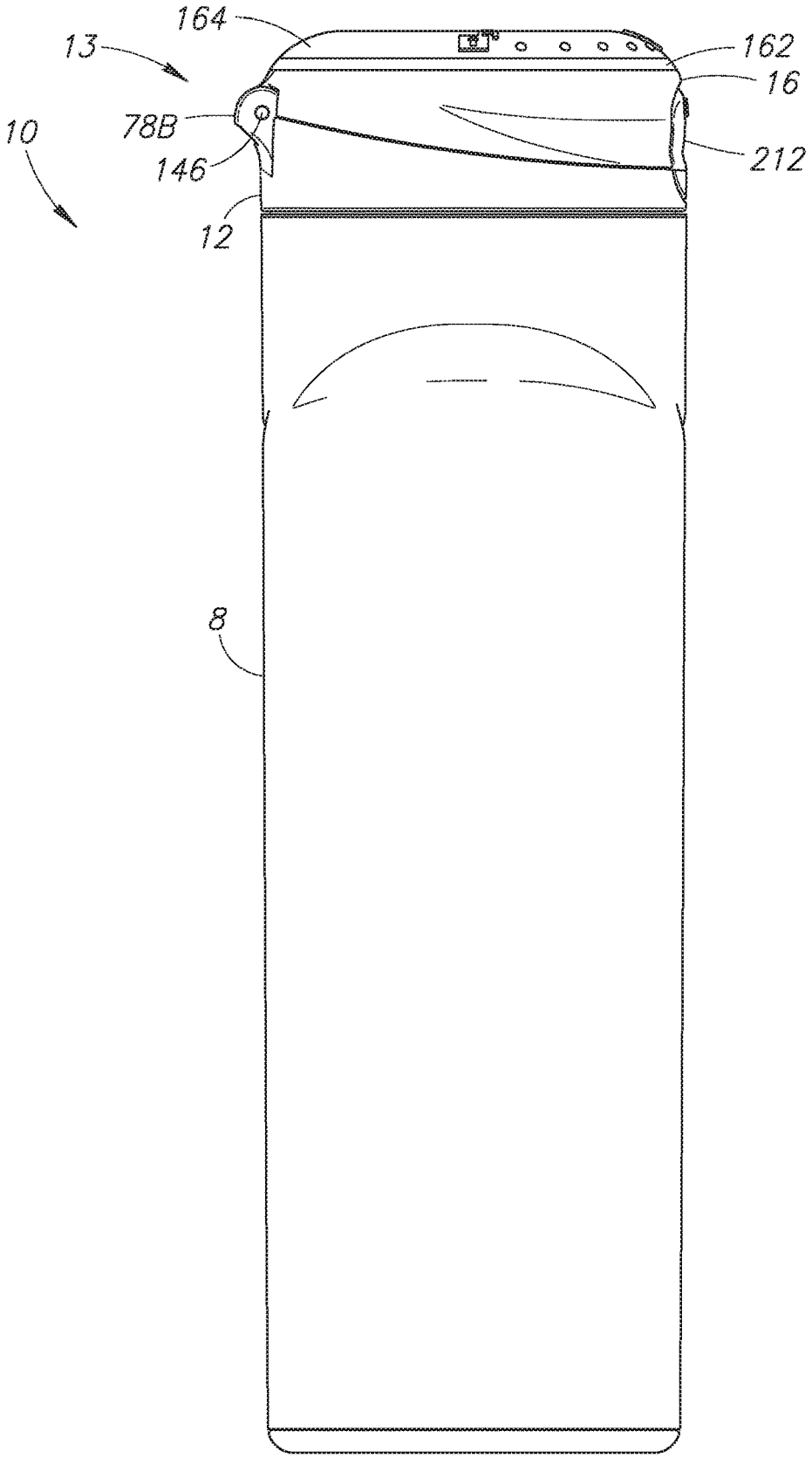
FIG. 4 illustrates a right side elevational view of the lockable beverage container closure and beverage container.
Figure 5:
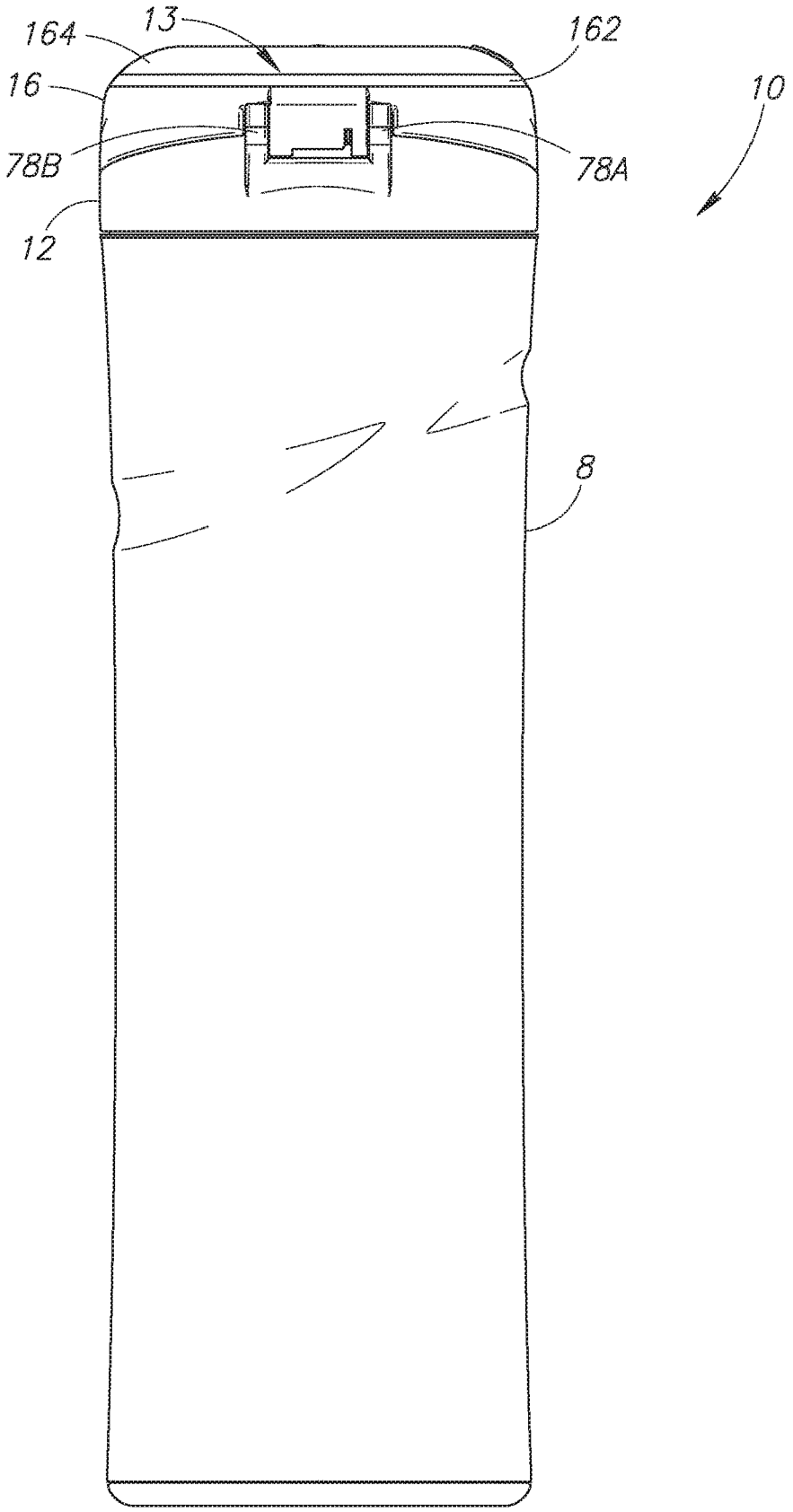
FIG. 5 illustrates a rear elevational view of the lockable beverage container closure and beverage container.
Figure 6:
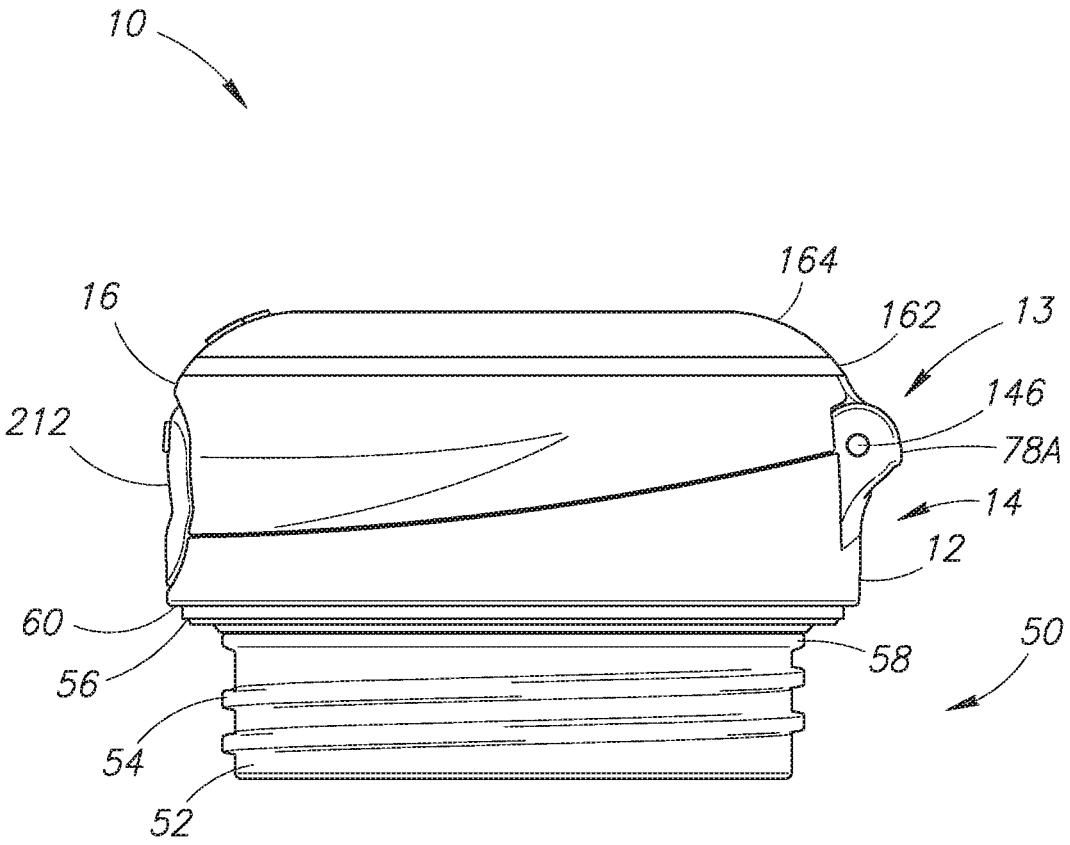
FIG. 6 illustrates a left side elevational view of the lockable beverage container closure without the beverage container.
Figure 7:
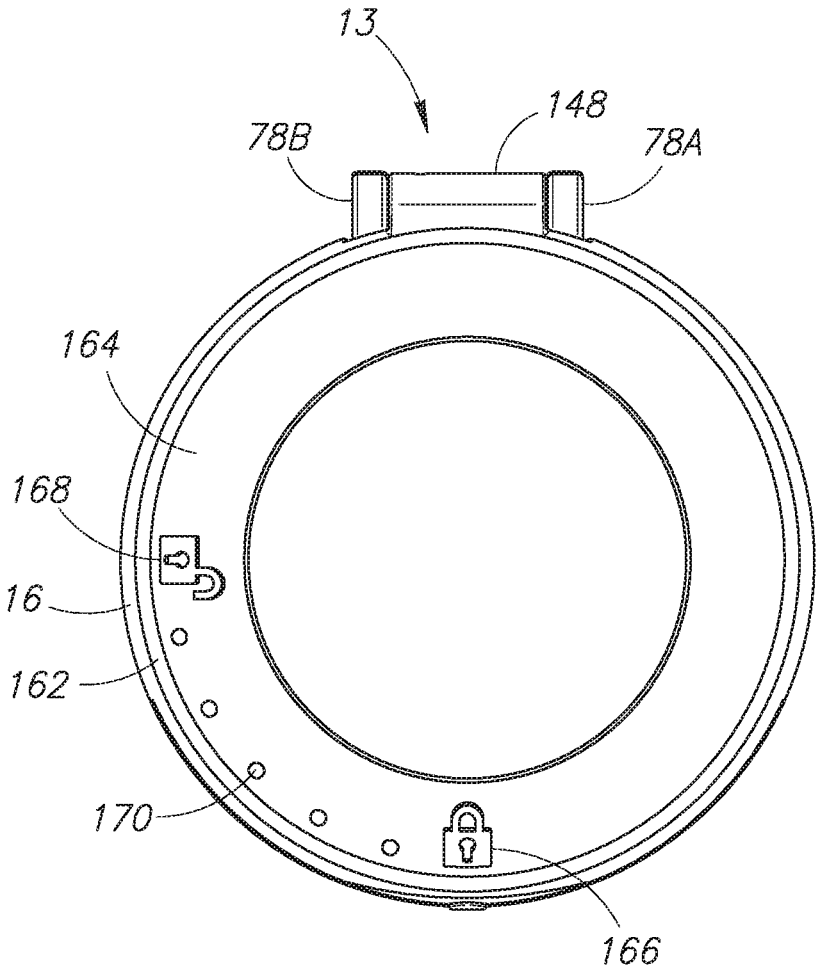
FIG. 7 illustrates a top plan view of the lockable beverage container closure.
Figure 8:
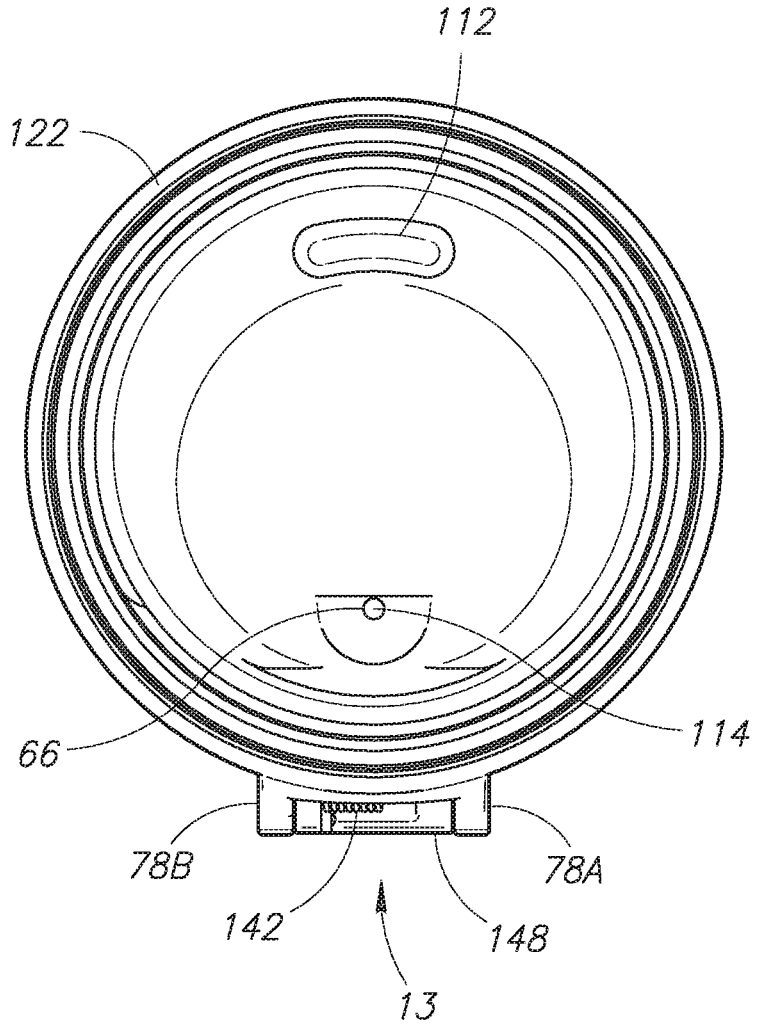
FIG. 8 illustrates a bottom plan view of the lockable beverage container closure.

A beverage container closure or lid, in accordance with an embodiment of the present invention, is generally indicated by reference numeral 10 in FIG. 1. The lid 10 has a generally cylindrical main body 12 that is adapted for closing an open end of a conventional drinking vessel or beverage container 8. The beverage container 8 may be any suitable type of container such as the tumbler type (that is, without a handle) for use in automotive beverage receptacles, or for transport in backpacks, book bags, and the like. As shown in FIG. 6, the lid 10 is selectively couplable to the beverage container 8 by any suitable means such as threads 54 disposed on an outer surface of a sidewall 52 of a lower, downwardly depending portion 50 of the main body 12. The lid 10 also includes a flexible O-ring seal member 56 positioned adjacent the sidewall 52 of the lower portion 50 at a location near a bottom surface 60 of an upper portion 14 of the main body 12. Also disposed on the outer surface of the sidewall 52 is a retaining thread 58 for the seal member 56. The retaining thread 58 is operable to secure the positioning of the seal member 56 adjacent to the bottom surface 60 of the upper portion 14 of the main body 12. The particular configuration for mating the lid 10 to the container 8 is a matter of choice for one of ordinary skill in the art. Thus, although threads 54 and the seal member 56 have been shown in this embodiment, those of ordinary skill in the art will appreciate that any other means for attaching and sealing the lid 10 with respect to the beverage container 8 may be substituted.

Figure 12:
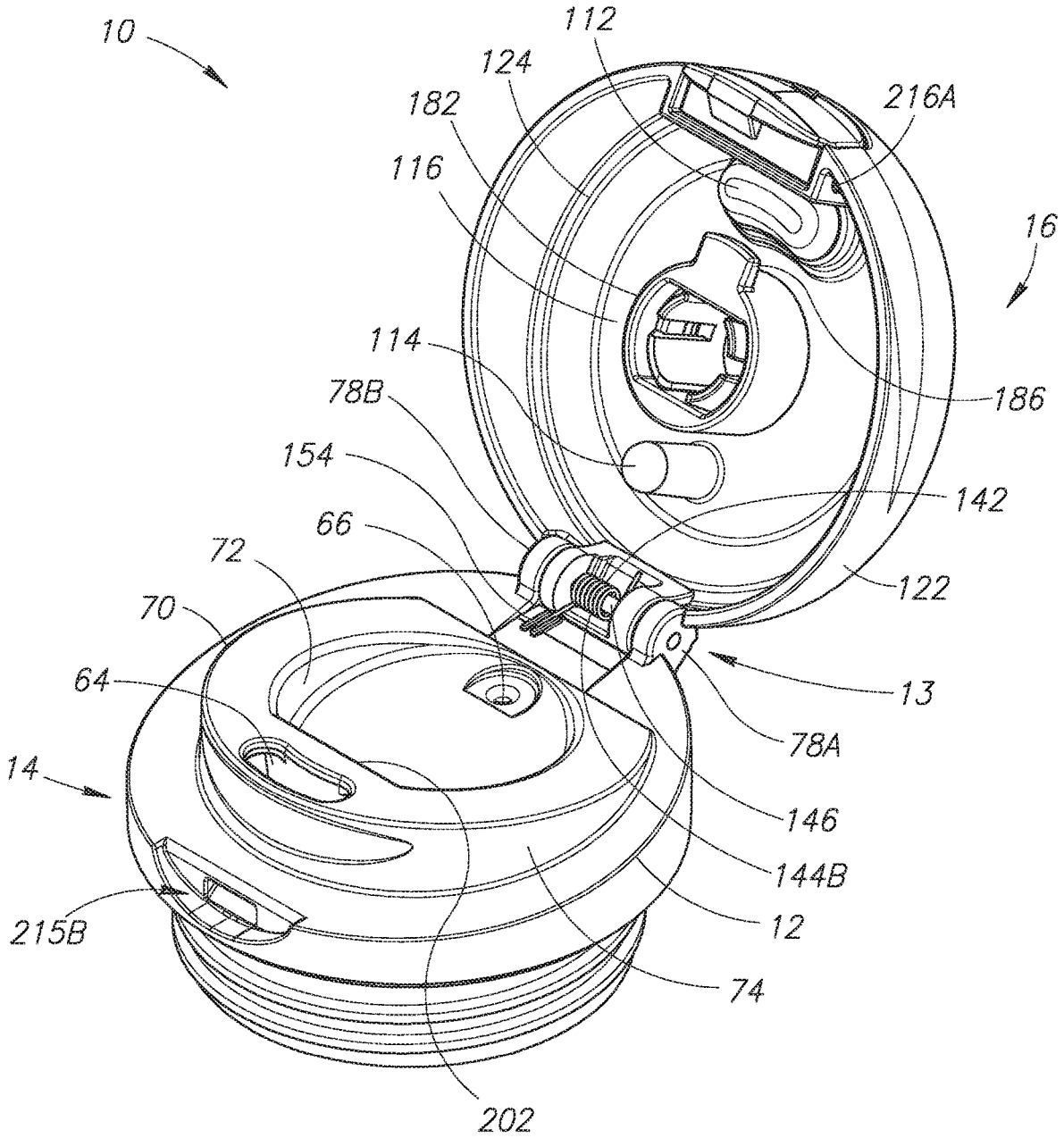
FIG. 12 illustrates an enlarged top left side perspective view of the lockable beverage container closure in the open position.

As best seen in FIG. 12, the upper portion 14 of the main body 12 also includes a drinking spout 70 configured for contact with a user's lips when the entire assembly comprising the beverage container 8 and the lid 10 is tipped toward the user with the lid 10 open, such that the user may drink from the beverage container 8 to which the lid 10 is attached. The drinking spout 70 is configured with an aperture or drinking opening 64 configured to permit fluid passage therethrough when a user drinks a beverage. The upper portion 14 of the main body 12 of the lid 10 also includes a vent hole 66 that serves as an air breather hole to allow air to flow into the beverage container 8 when fluid is passing out of the drinking spout 70. The annular-shaped inner wall portion 72 of the drinking spout 70 operates to contain any liquid released through the vent hole 66.

Figure 11:
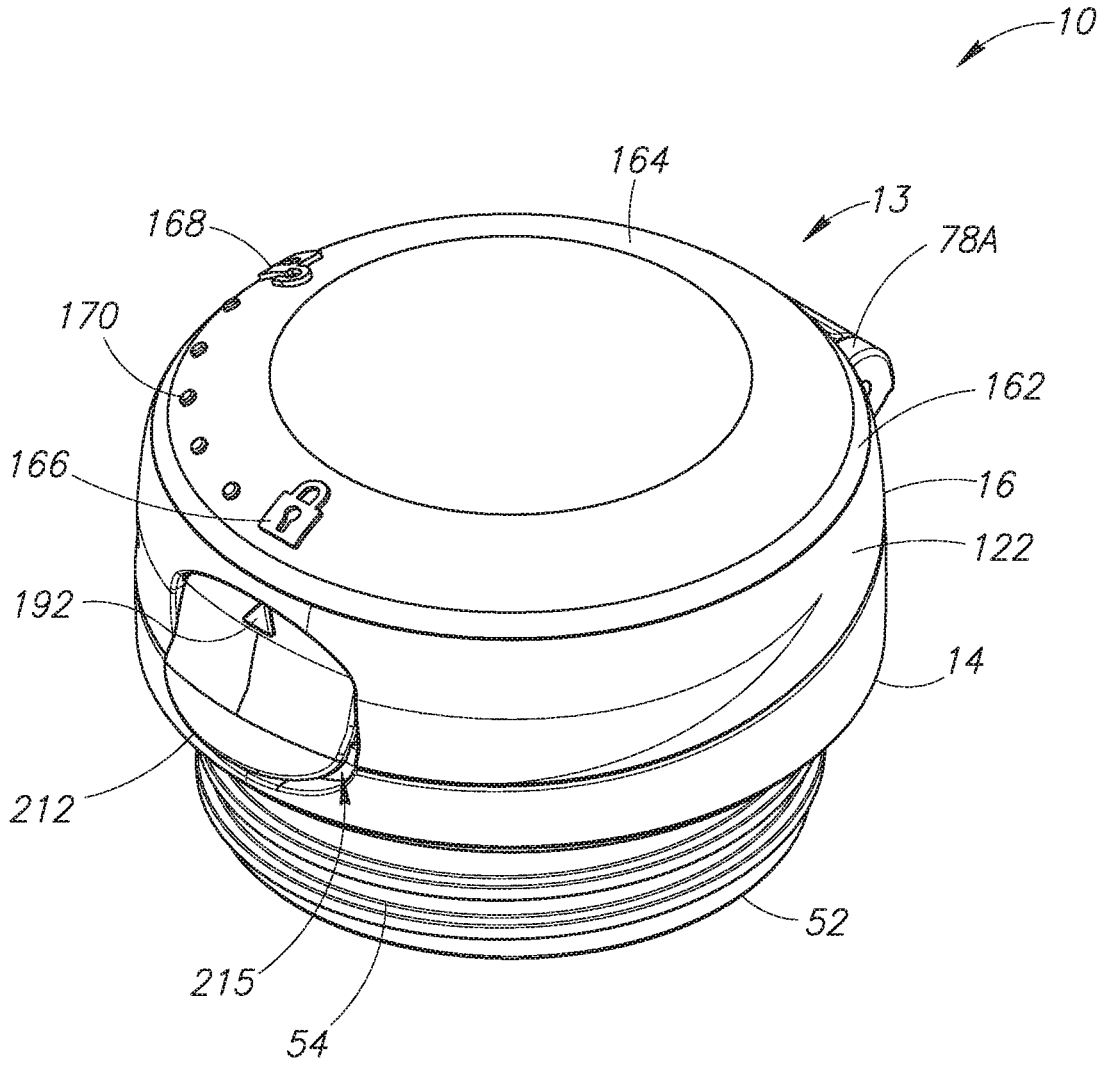
FIG. 11 illustrates an enlarged top left side perspective view of the lockable beverage container closure in the closed position.
Figure 18:
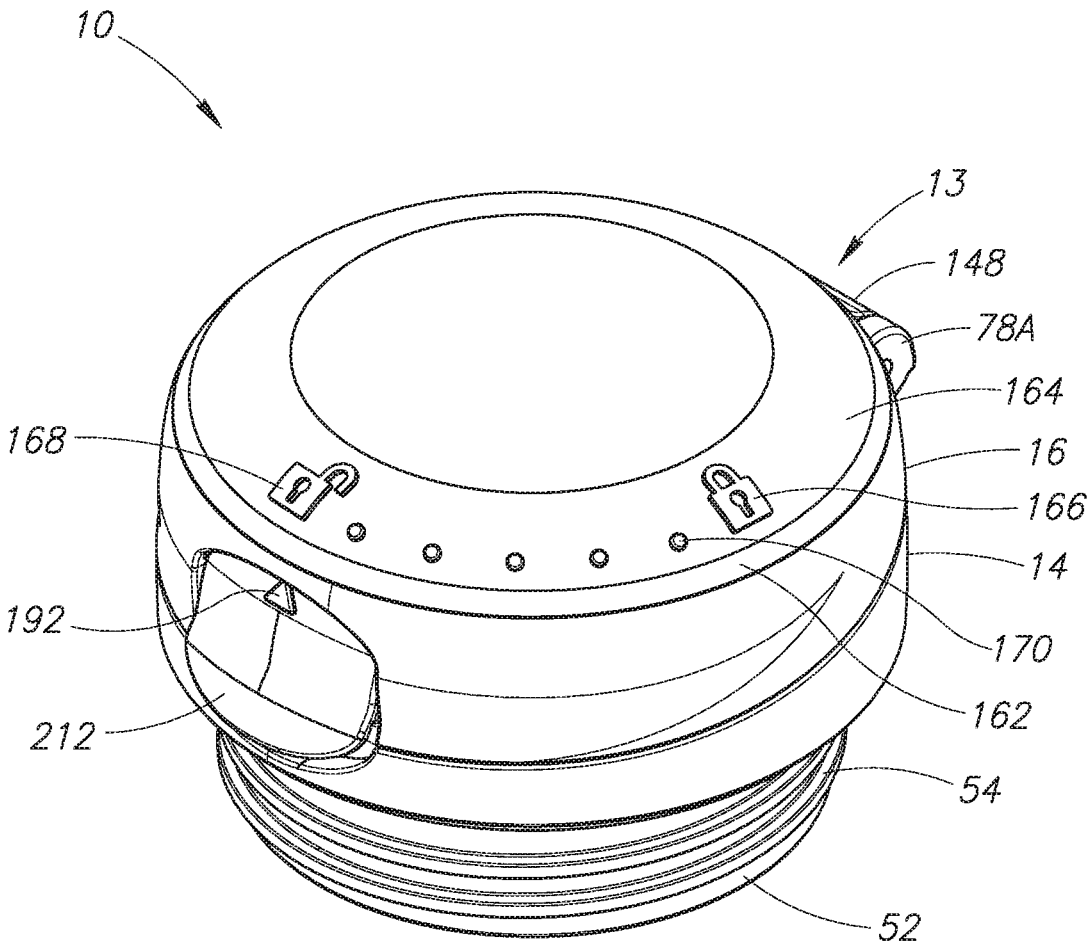
FIG. 18 illustrates an enlarged top left side perspective view of the lockable beverage container closure with a second locking mechanism of the lockable beverage container closure actuated to the unlocking position.
Figure 19:
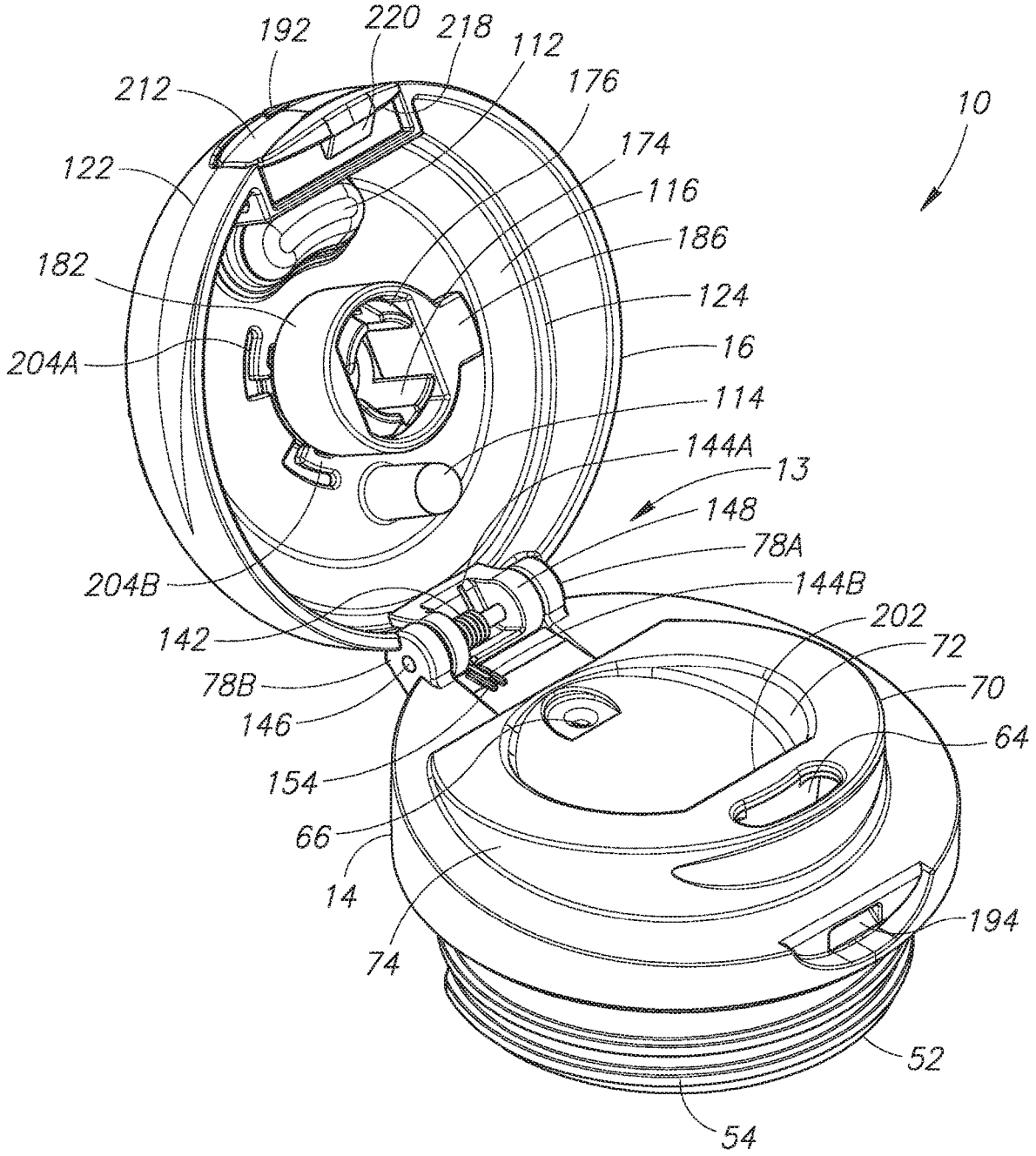
FIG. 19 illustrates an enlarged top right side perspective view of the lockable beverage container closure in the open position.
Figure 20:
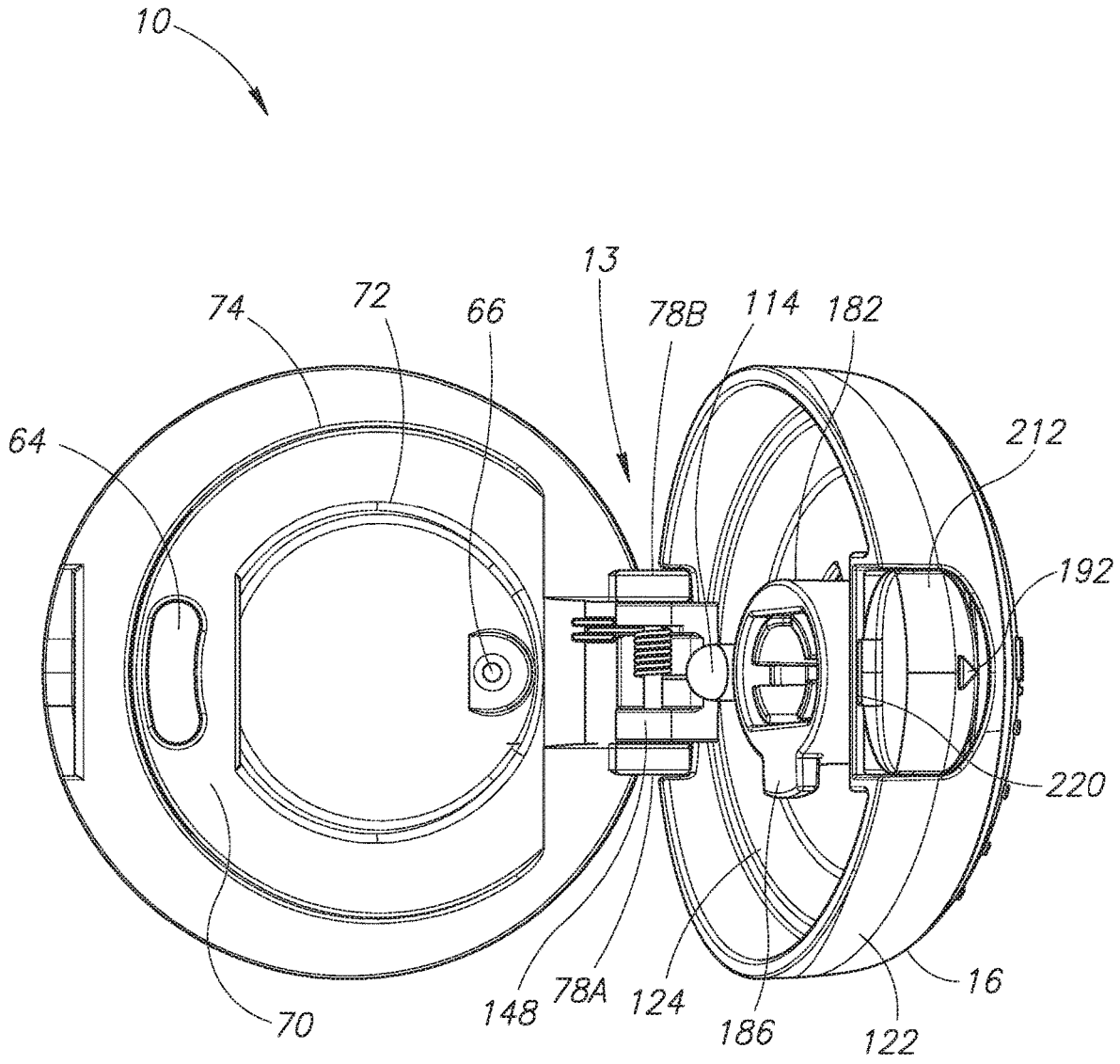
FIG. 20 illustrates a top plan view of the lockable beverage container closure in the open position.
Figure 21:
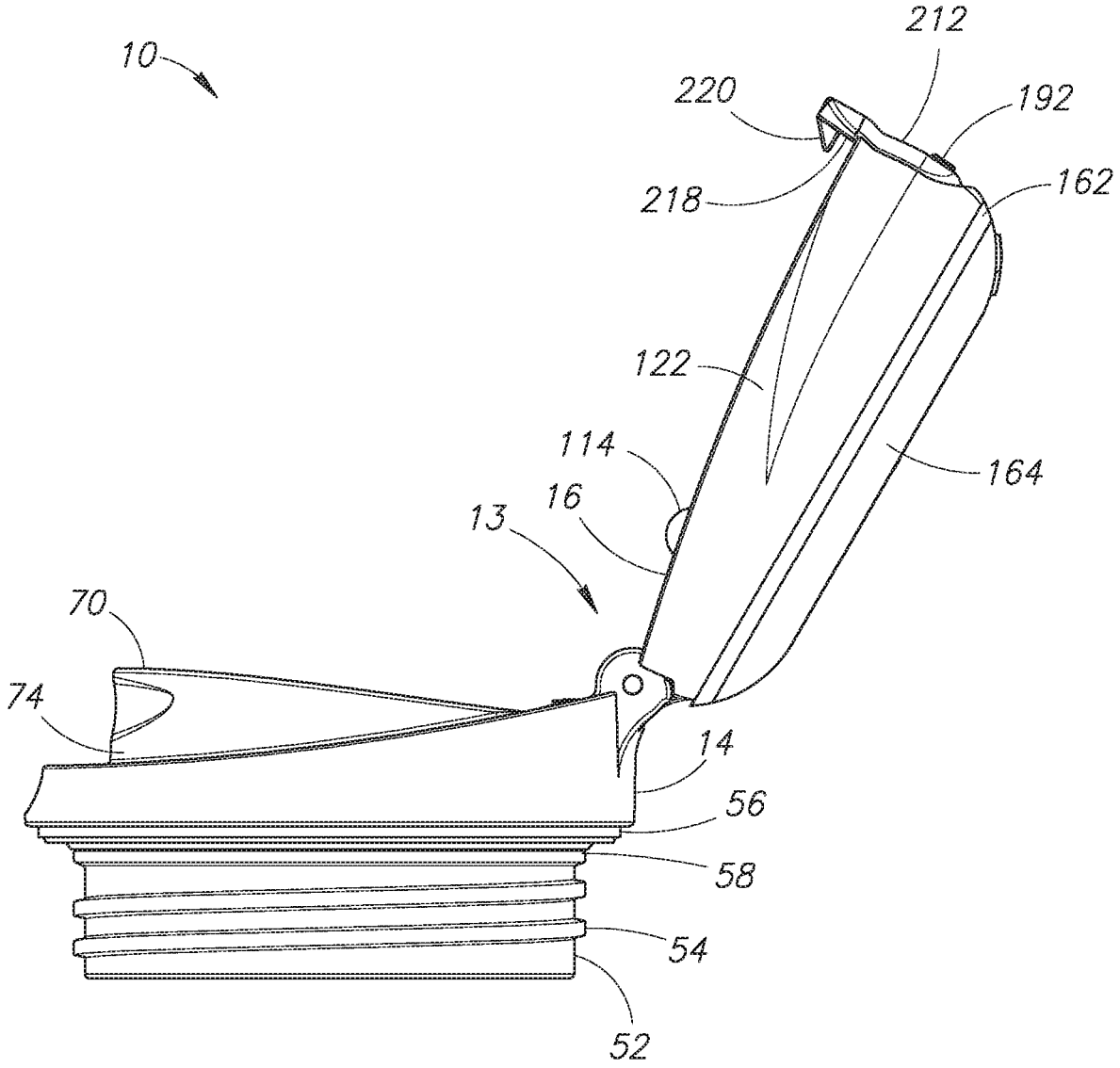
FIG. 21 illustrates a left side elevational view of the lockable beverage container closure in the open position.
Figure 22:
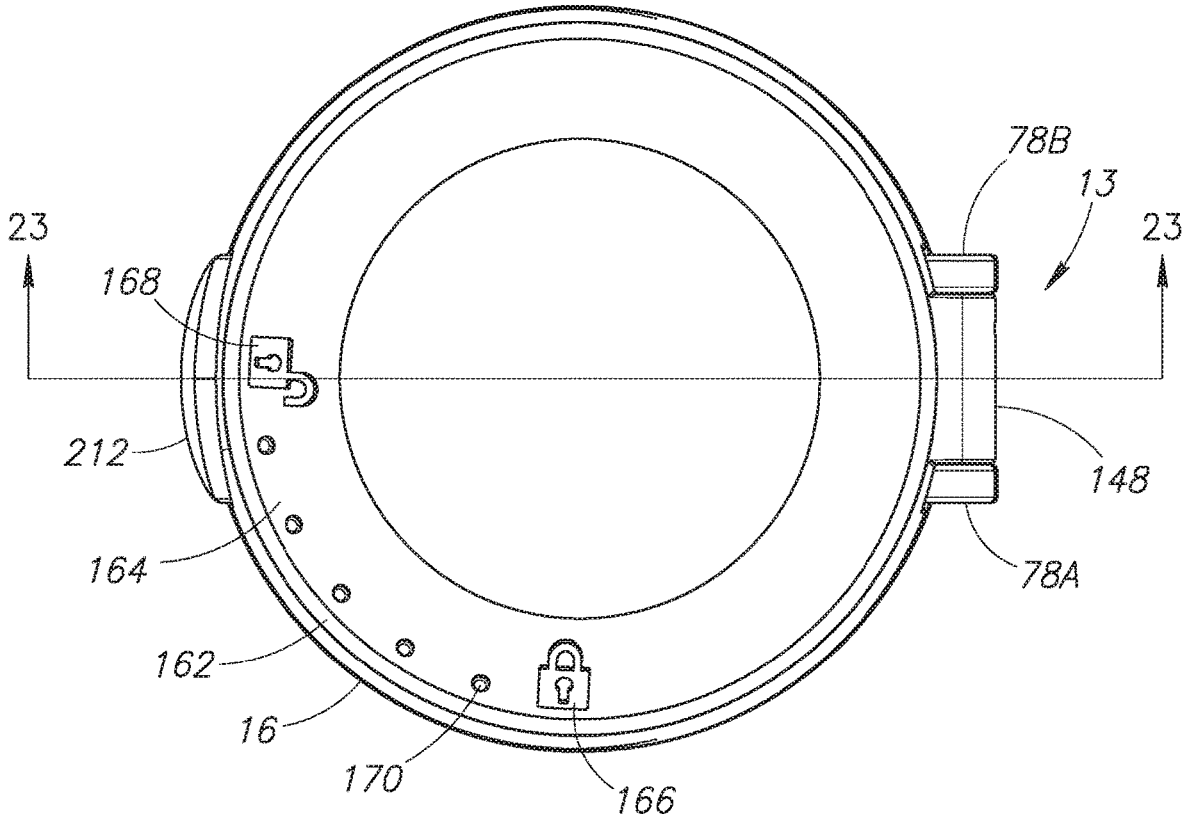
FIG. 22 illustrates a top plan view of the lockable beverage container closure with the first locking mechanism and the second locking mechanism of the lockable beverage container closure in the unlocking positions.

Coupled to the upper portion 14 of the main body 12 of the lid 10 is a lid cover 16. The lid cover 16 is operable to transition between a closed position (as shown in FIGS. 11 and 18) and an open position (as shown in FIGS. 12, 13 and 19-21). The lid cover 16 has a substantially circular surface and a substantially circumferential downwardly extending exterior wall 122. The exterior wall 122 is operative to enclose the drinking spout 70 and vent hole 66 of the main body 12 of the lid 10 when the lid cover is in the closed position. Also extending downwardly from the lid cover 16 is an interior wall 124. The interior wall 124 may have a plurality of portions and may be operative to abut an exterior wall 74 of the drinking spout when the lid cover 16 is in the closed position so as reduce lateral movement of the lid cover 16 with respect to a vertical axis of the main body 12 of the lid 10.

Figure 10:
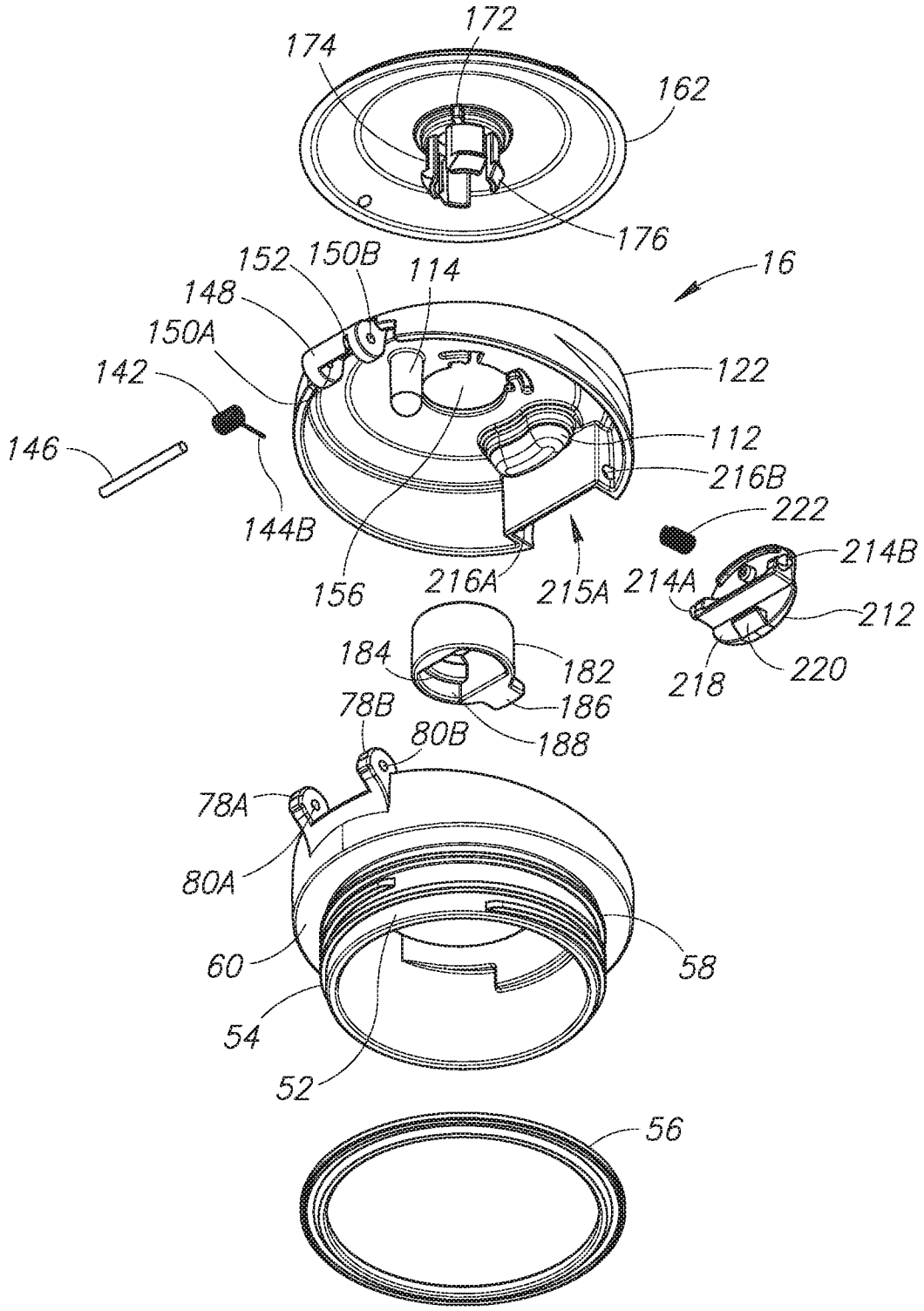
FIG. 10 illustrates an exploded bottom right side perspective view of the lockable beverage container closure.

The lid cover 16 is coupled to the main body 12 using a hinge mechanism 13 that permits the rotation of the lid cover 16 about a transverse rotary axis of the hinge. To enable the hinge mechanism 13, the main body 12 is configured with a pair of spaced apart arms 78A, 78B, whereby each arm has a respective aperture 80A, 80B extending therethrough, as shown in FIG. 10. The apertures 80A, 80B are adapted for receiving a hinge pin 146, whereby the apertures 80A, 80B permit initial passage of the hinge pin 146 (when the hinge mechanism is assembled) and subsequently hold the hinge pin 146 to enable rotatably coupling the lid cover 16 and the main body 12.

As shown in FIG. 10, the lid cover 16 includes an inner arm portion 148 having inner arm portion apertures 150A, 150B. The inner arm portion 148 is configured with a pocket for receiving a torsion spring 142 having two radially extending ends 144A, 144B. The torsion spring 142 is formed by a series of helically wound coils defining an open interior. When assembled, the torsion spring is fitted in the pocket of the inner arm portion 148, and the inner arm portion 148 is inserted between the spaced apart arms 78A, 78B of the main body 12 so that the arm apertures 80A, 80B, the inner arm portion apertures 150A, 150B and the open interior of the torsion spring 142 are axially aligned. Further, the inner arm portion 148 is configured with a first holding slot 152 for receiving the first extending end 144A of the torsion spring 142 and the main body 12 is configured with a second holding slot 154 for receiving the second extending end 144B of the torsion spring 142, as best seen in FIG. 12. The hinge pin 146 is fitted into the arm apertures 80A, 80B, the inner arm portion apertures 150A, 150B and the open interior of the torsion spring 142, thereby relatively rotatably connecting together the lid cover 16 and the main body 12.

Figure 15:
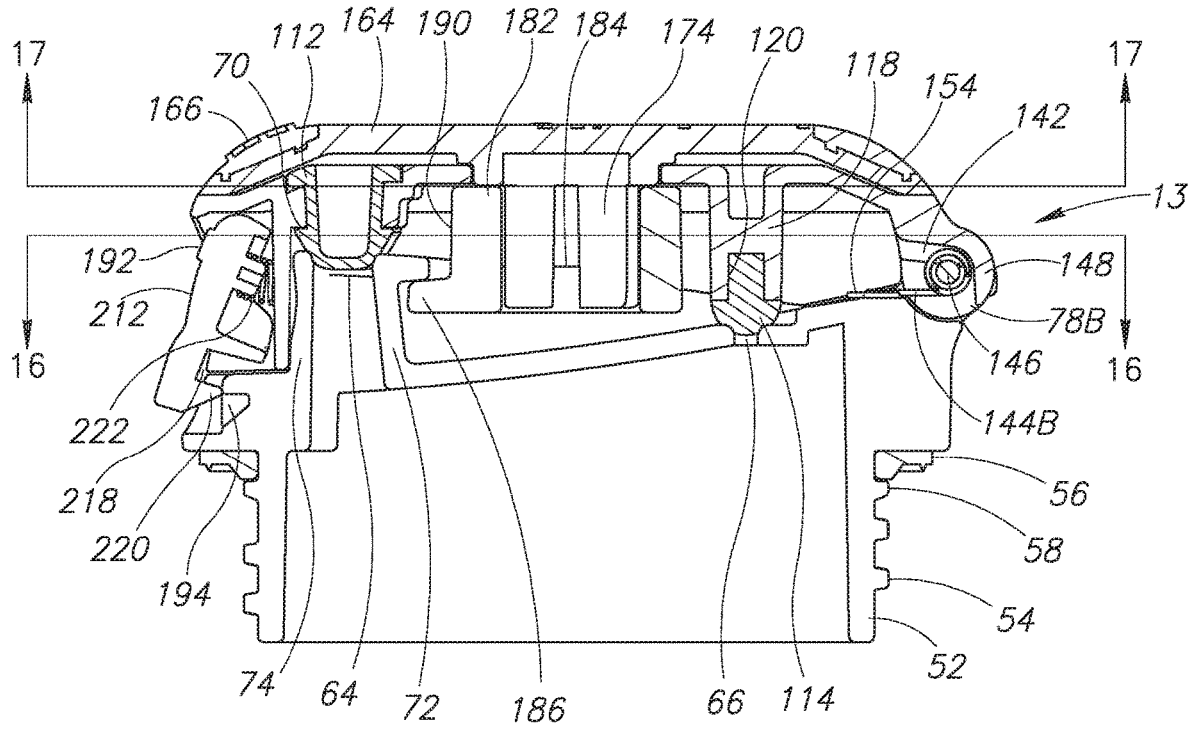
FIG. 15 illustrates a cross-sectional view of the lockable beverage container closure taken substantially through line 15-15 of FIG. 14 with a first locking mechanism of the lockable beverage container closure in the locking position.
Figure 16:
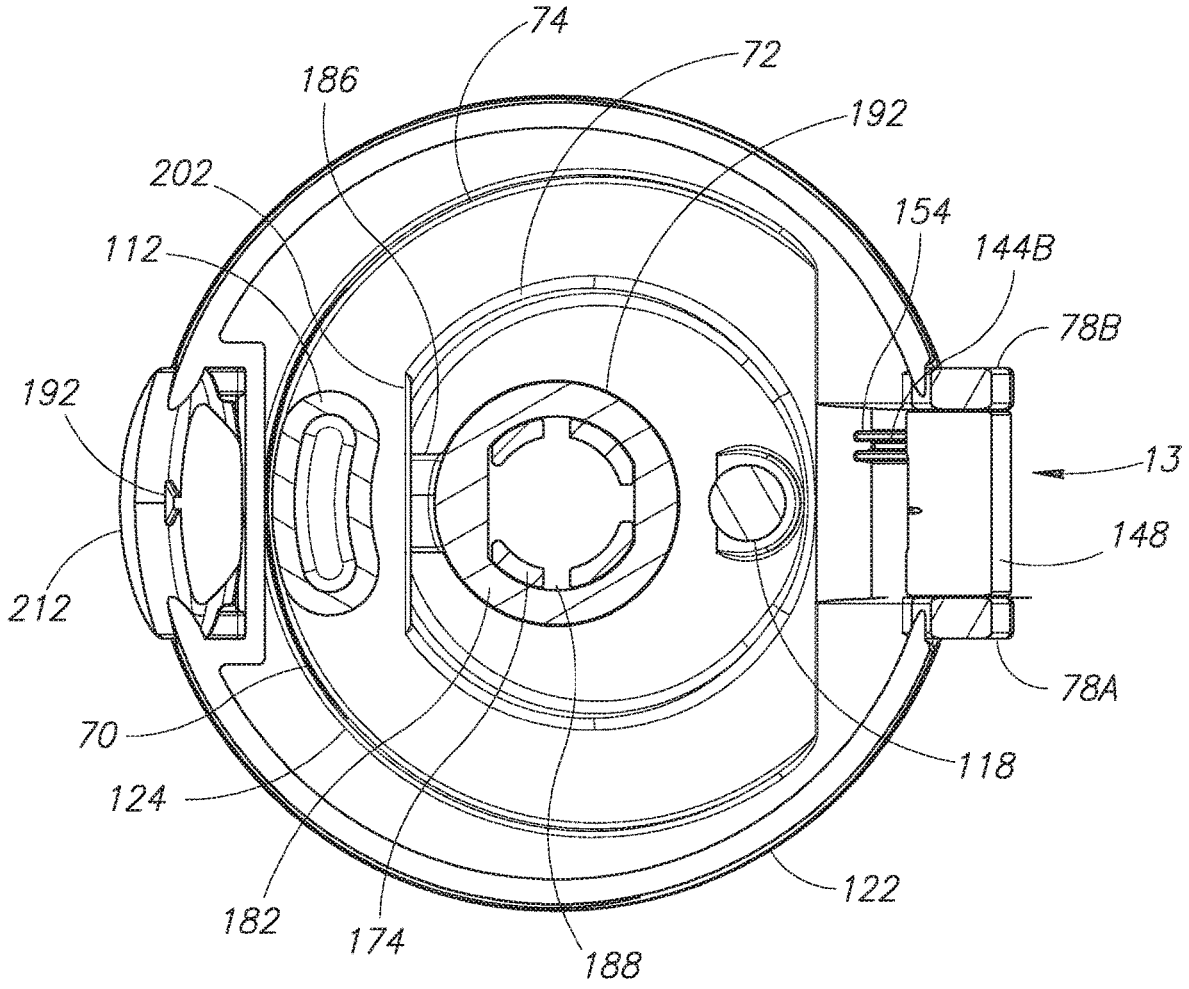
FIG. 16 illustrates a cross-sectional view of the lockable beverage container closure taken substantially through line 16-16 of FIG. 15.
Figure 23:
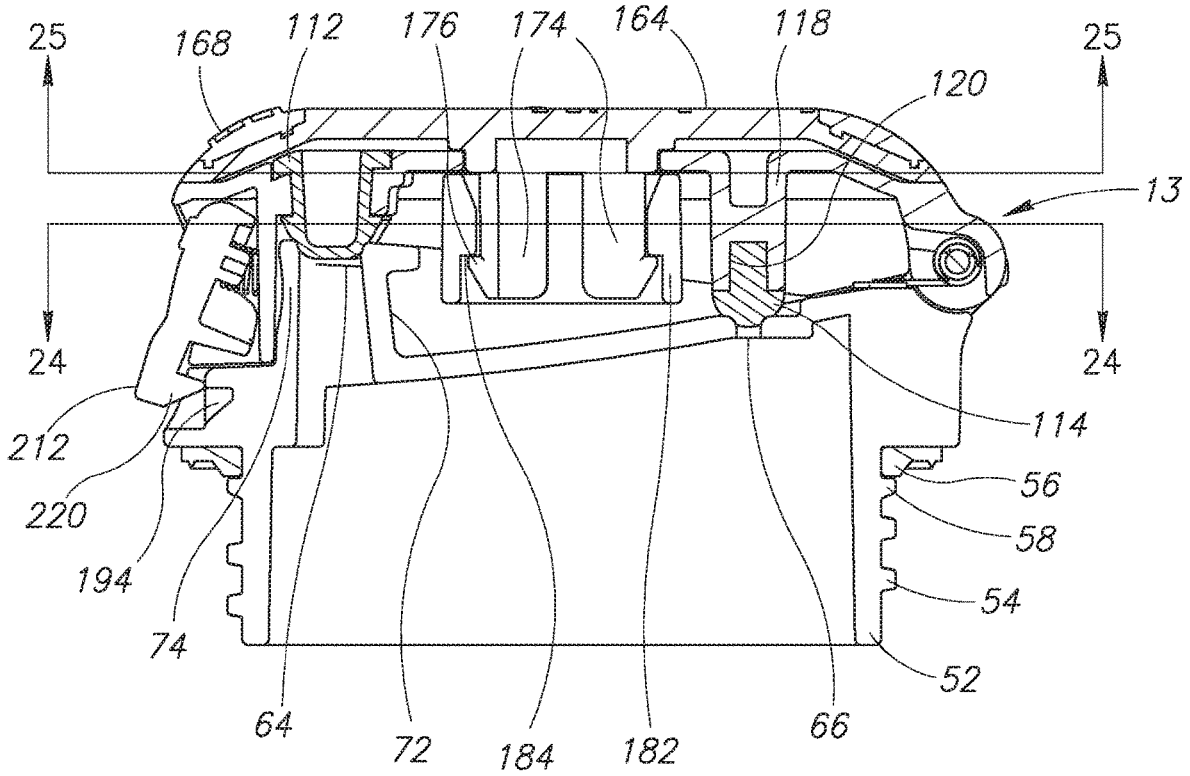
FIG. 23 illustrates a cross-sectional view of the lockable beverage container closure taken substantially through line 23-23 of FIG. 22.
Figure 24:
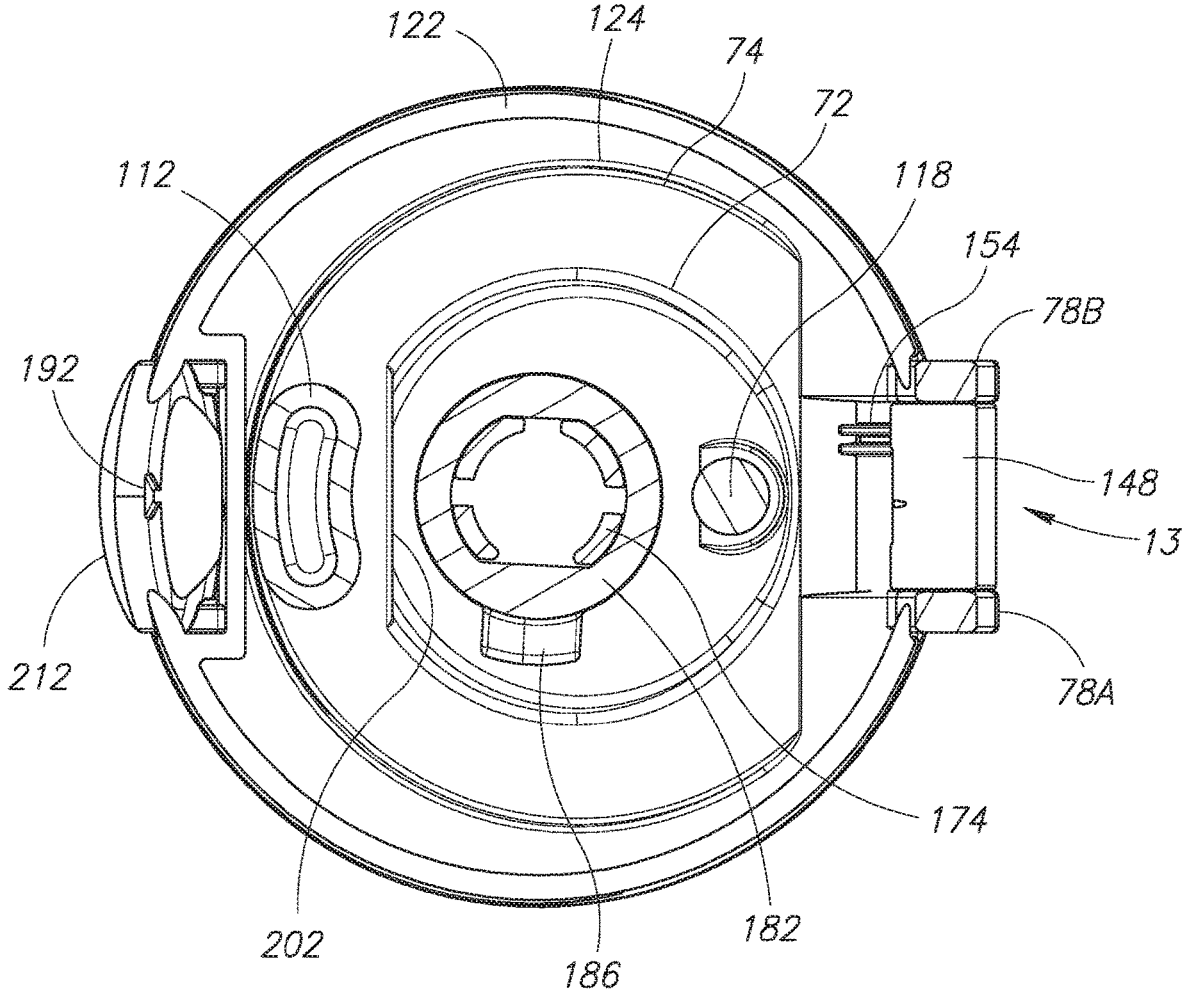
FIG. 24 illustrates a cross-sectional view of the lockable beverage container closure taken substantially through line 24-24 of FIG. 23.

As shown in FIG. 12, disposed on an interior surface 116 of the lid cover 16 is a drinking opening plug 112 and a vent hole plug 114. The drinking opening plug 112 (commonly also referred to as a stopper or seal) may be formed from a flexible material and is contoured so as to fit the drinking opening 64. When pressed against the drinking opening 64 in the closed position, the drinking opening plug 112 operates to seal the drinking opening 64 and thereby prevent the passage of fluid or other substance through the drinking opening 64. The vent hole plug 114 may also be formed from a flexible material and operates to seal the vent hole 66 when the lid 10 is in the closed position. As is recognized, the positioning of the drinking opening plug 112 and a vent hole plug 114 in relation to the interior surface 116 of the lid cover 16 corresponds to the respective placement of the drinking opening 64 and the vent hole 66 in the main body 12 of the lid 10 such that when the lid 10 is closed due to an engagement of the cover 16 and the main body 16 as described herein, passage of liquid or another substance through the drinking opening 64 or the vent hole 66 is prevented. Further, as may be best viewed in FIGS. 15 and 23, a support portion 118 is used to position the vent hole plug 114 away from the interior surface 116 of the lid cover 16 so that it can reach of the vent hole plug 114. A recess 120 in the support portion 118 is adapted for receiving and holding a portion of the vent hole plug 114 therein.

Locking Mechanisms

The lid 10 has a dual-locking mechanism comprising an actuated disk lock and a press-button lock. Passage of fluid or another substance through the drinking opening 64 may only be permitted if both locking mechanisms of the lid 10 are actuated to be in an unlocking position. If at least one of the locking mechanisms of the lid 10 is in the locking position, the lid 10 is configured such that the drinking opening plug 112 seals the drinking opening 64 and a fluid or another substance is prevented from passing through the drinking opening 64. Similarly, the vent hole plug 114 prevents fluid or another substance from passing through the vent hole 66. The dual-locking mechanism is advantageous in that if one locking mechanism is accidentally actuated, the second locking mechanism may serve as a safety and prevent the lid 10 from being placed in an open position.

Figure 9:
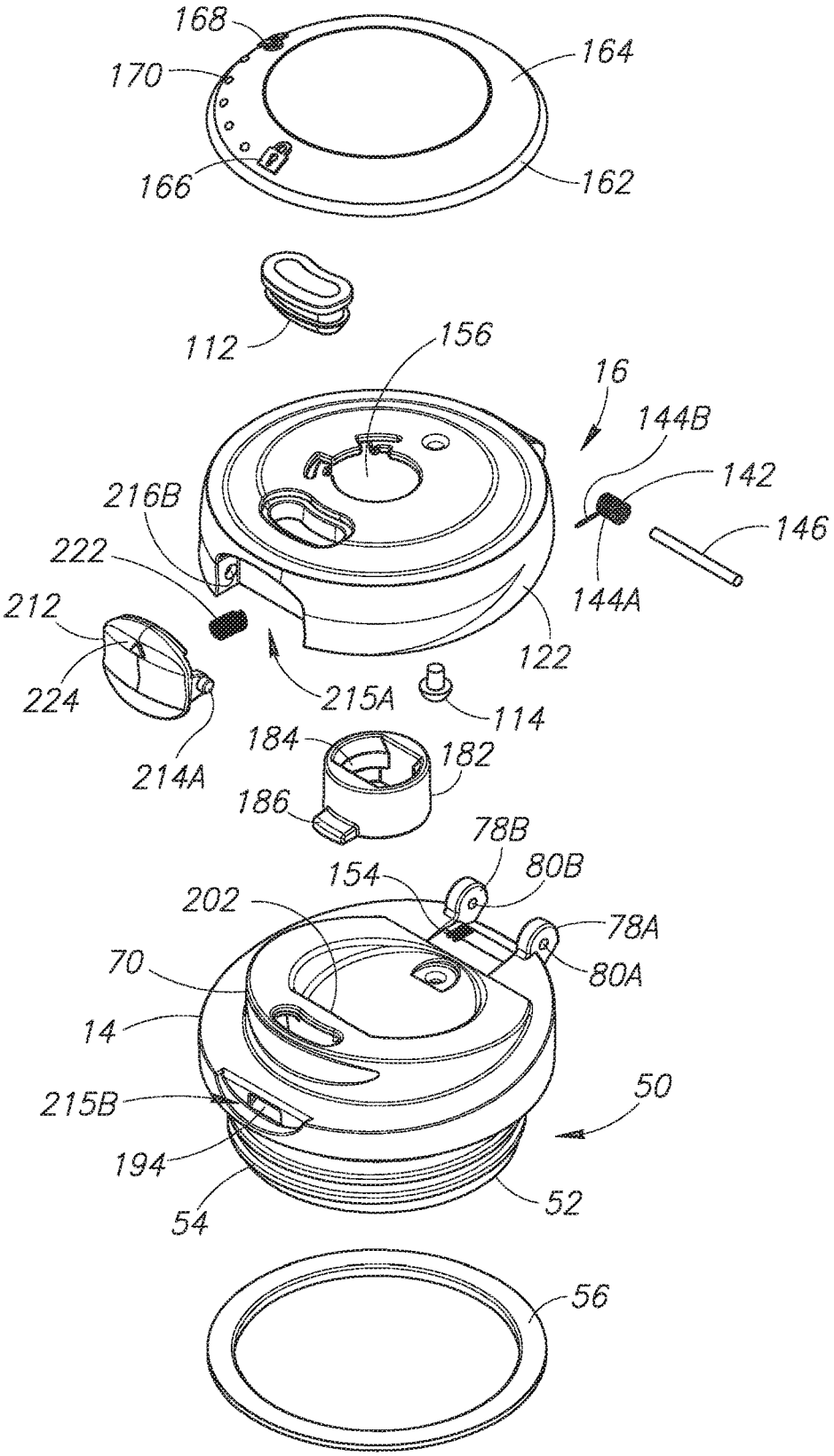
FIG. 9 illustrates an exploded top left side perspective view of the lockable beverage container closure.

A first locking mechanism includes, disposed on an exterior surface of the lid cover 16, a manually rotatable actuation disk 162 having a top grip surface 164. As shown in FIG. 10, extending downwardly from a bottom surface of the actuation disk 162 are four legs 174 (also singularly referred to herein by the same numeral) configured to pass through an aperture 156 of the lid cover 16. The legs 174 are also configured to pass through a locking ring 182 disposed adjacent to an interior surface of the lid cover 16. The downwardly extending legs 174 are further configured with a slanted finger portion 176 operative to reach around and snap-fit about a shoulder 184 disposed on an interior surface 188 of the locking ring 182. The locking ring 182 is shown in FIGS. 9 and 10 as a hollowed cylindrical walled member having the shoulder 184 disposed on its interior surface 188. Disposed on an exterior surface 190 of the locking ring 182 is an outwardly projecting tab 186. When the actuation disk 162 and the locking ring 182 are assembled, the outwardly projecting tab 186 is rotatably coupled to the top cover 162 such that rotation of the actuation disk 162 results in circular movement of the tab 186, whereby the actuation disk 162 may be rotatable in plane that is transverse to a longitudinal axis of the drink arrangement.

Figure 13:
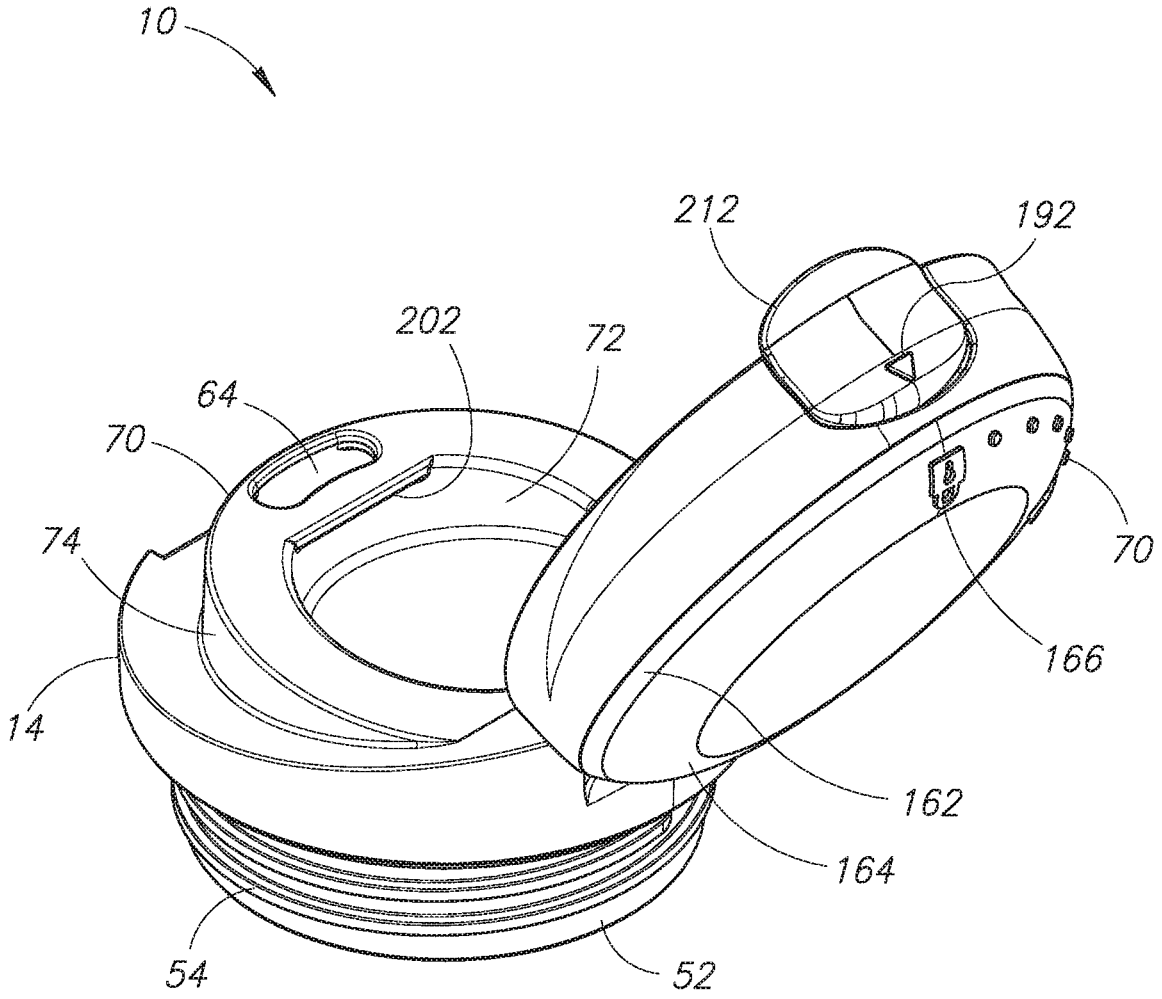
FIG. 13 illustrates an enlarged top left side perspective view of the lockable beverage container closure in the open position.
Figure 14:
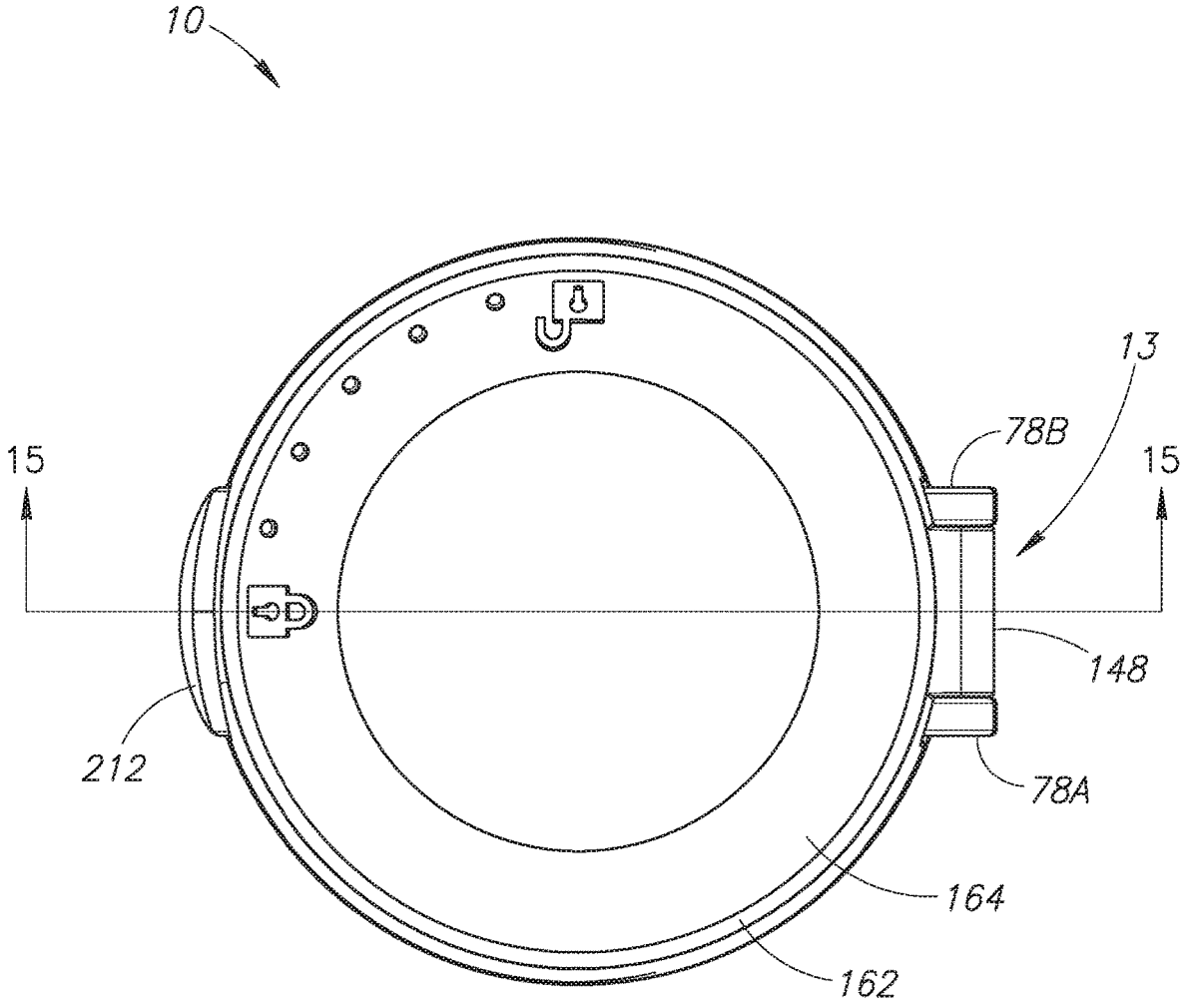
FIG. 14 illustrates a top plan view of the lockable beverage container closure.

As shown in FIG. 13, provided in an inner wall portion 72 of the drinking spout 70 of the main body 12 of the lid 10 is a ledge 202 for positioning of the tab 186 thereunder when the tab 186 is positioned adjacent to the ledge 202. When the tab 186 is caught by the ledge 202, the lid cover 16 cannot be rotated upward about the hinge mechanism 13 and thereby is secured in the closed position. Further circular motion of the tab 186 in a direction away from the ledge 202 (as a result of rotary actuation of the actuation disk 162) frees the tab 186 from the ledge 202 and enables rotation of the lid cover 16 upward about the hinge mechanism 13 and away from the main body 12 of the lid 10.

The top grip surface 164 of the actuation disk 162 has disposed thereon lock indicia 166, unlock indicia 168 and nubs 170. The nubs 170 are provided to facilitate manual gripping of the grip surface 164 and hence rotation of the actuation disk 162. The lock indicia 166 and unlock indicia 168 are provided to indicate to a user whether the first locking mechanism using the tab 186 enabled by the actuation disk 162 is in the locking position or in the unlocking position. An alignment mark 192 disposed on the lid 10 serves as a position reference to the lock indicia 166 and the unlock indicia 168.

Figure 17:
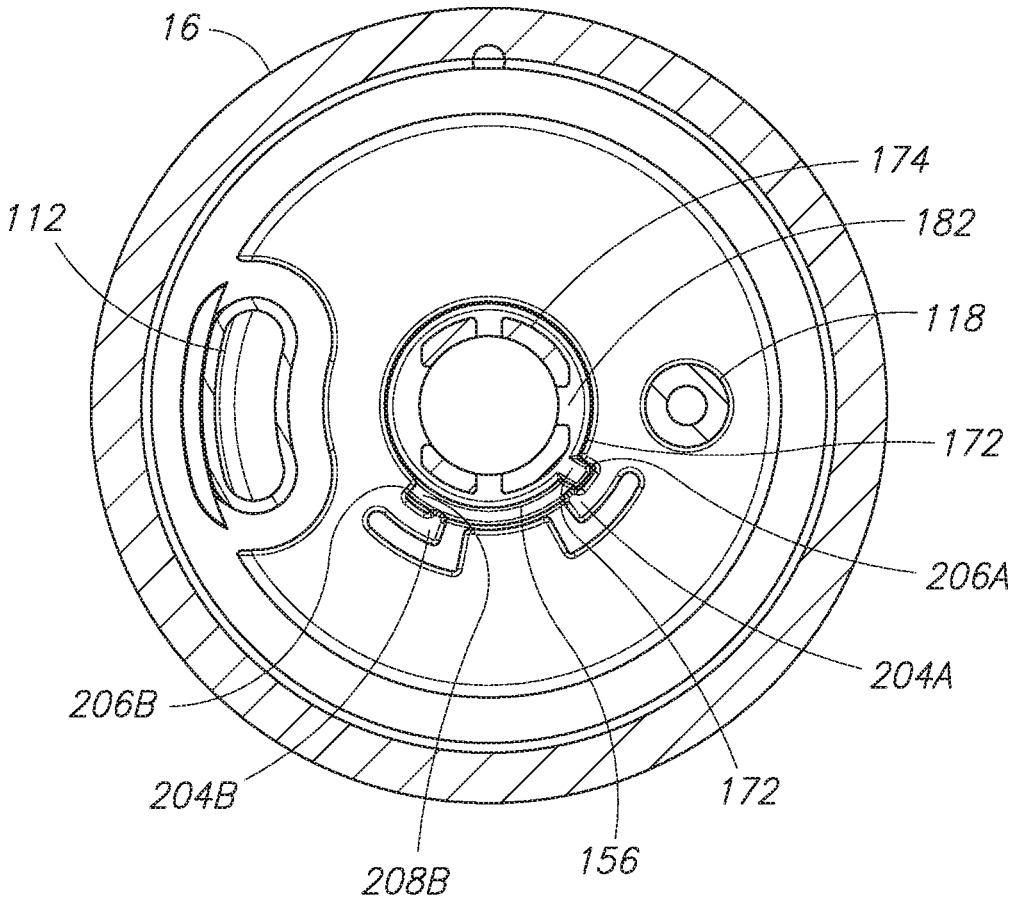
FIG. 17 illustrates a cross-sectional view of the lockable beverage container closure taken substantially through line 17-17 of FIG. 15.
Figure 25:
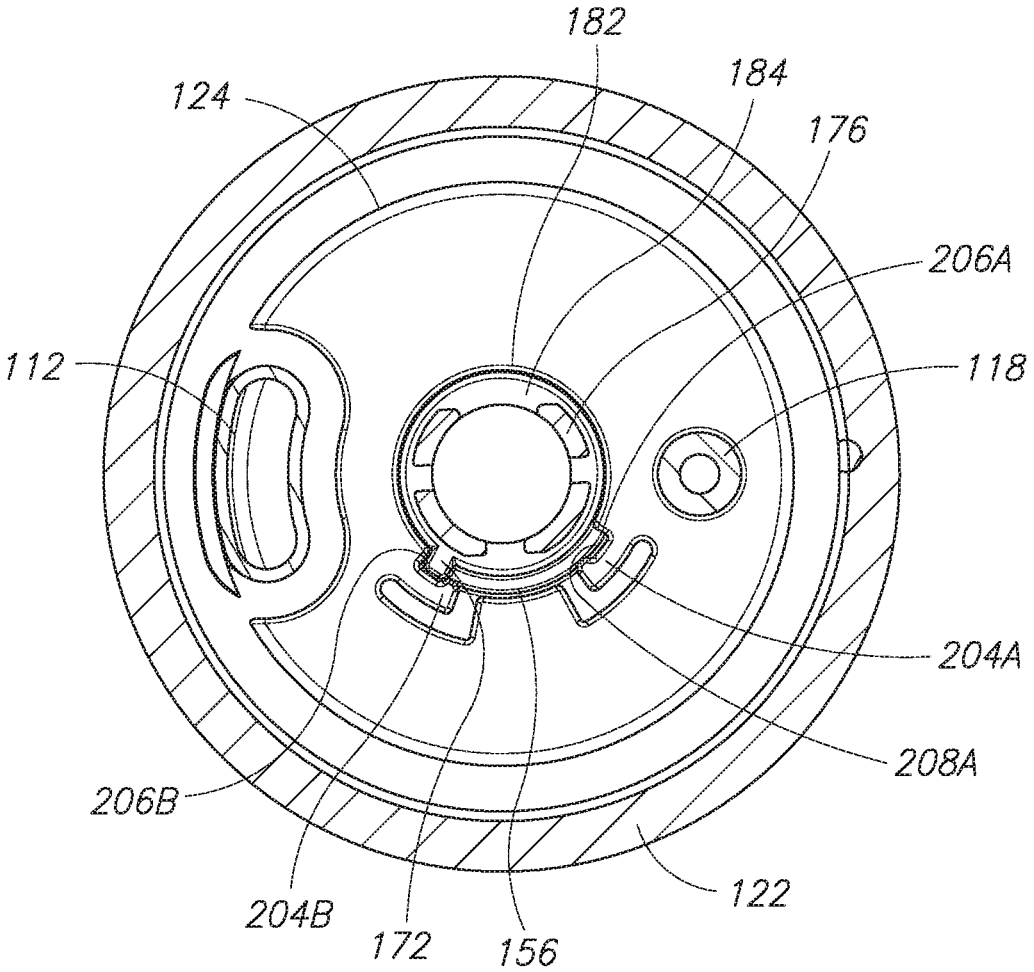
FIG. 25 illustrates a cross-sectional view of the lockable beverage container closure taken substantially through line 25-25 of FIG. 23.

A tab 172 shown in FIG. 10 is disposed on the bottom or interior surface of the actuation disk 162 and rotates with the actuation disk. The tab 172 is configured such that the rotation of the actuation disk 162 and tab 172 assembly is restricted to an arc between the locking and unlocking positions. The aperture 156 of the lid cover 16 is contoured such that the tab 172 is used to restrict the rotational movement of the actuation disk 162 to that arc. As may be best viewed in FIG. 17, when the actuation disk 162 is rotated to the locking position, the tab 172 is near or abuts a first wall 206A of the aperture 156. Conversely, as may be best viewed in FIG. 25, when the actuation disk 162 is rotated to the locking position, the tab 172 is near or abuts a second wall 206B of the aperture 156. The aperture 156 is further configured to permit the tab 172 to move along the arc between the two walls 206A, 206B.

The aperture 156 is further configured to provide for two resilient arms 204A, 204B formed in the lid cover 16. Each resilient arm 204A, 204B is operative to snap-lock the tab 172 in a respective recess 208A, 208B of the resilient arm. The application of increased rotational force on the actuation disk 162 is required to move the tab 172 into and out of each recess 208A, 208B. After freeing the tab 172 from a resilient arm 204A, 204B, the tab 172 may be moved more easily between the resilient arms 204A, 204B. The resilient arms 204A, 204B have the effect of retaining the actuation disk 162 in the locking or unlocking positions until the rotational force applied to the actuation disk 162 is strong enough to exceed a threshold. Accordingly, the resilient arms 204A, 204B may reduce the likelihood of accidental or unintentional rotation of the first locking mechanism and opening of the lid cover 16.

A second locking mechanism is used for releasably securing the cover 16 to the body 12 of the lid 10. As shown in FIGS. 9 and 10, two pivot pin apertures 216A, 216B are provided in opposing walls defining an exteriorly opening front recess 215A in the exterior wall 122 of the lid cover 16. The two pivot pin apertures 216A, 216B are configured to rotatably receive two pivot pins 214A, 214B of a button plate 212 positioned in an upper portion within the recess 215A. A lower portion of the button plate 212 is positioned in an exteriorly opening front recess 215B in the main body 12 of the lid 10, immediately below the recess 215A when the lid is closed. An interior surface 218 of the button plate 212 has disposed thereon an inwardly projecting tongue portion 220 at a location below the hinge line defined by the two pivot pins 214A, 214B and configured to be received within a pocket 194 of the main body 12 of the lid 10 located within the recess 2156 for locking the lid 10 when closed. The interior surface 218 of the plate 212 is also configured for receiving a compression spring 222 at a location above the hinge line of the pins 214A, 214B and above the tongue portion 220. A second end of the compression spring 222 is received by the lid cover 16. The button plate 212 fits within the combined recess formed by the recess 215A and 215B when the lid 10 is closed. When the second locking mechanism is assembled, manual pressure exerted inward on the plate 212 causes the compression spring 222 to become compressed thus drawing the tongue portion 220 out of the pocket 194 and causing the second locking mechanism to be actuated to the unlocking position. The inwardly projecting tongue portion 220 is configured such that the manual rotation of the lid cover 16 downward about the hinge mechanism 13 to close the lid cover causes the tongue portion 220 to be received within the pocket 194 of the main body 12 of the lid 10 so as to securely lock the lid 10 in the closed position.

As described herein, the lid cover 16 can only be rotated to the open position upon actuation of the second locking mechanism if the actuation disk 162 of the first locking mechanism is rotated to the unlocking position. In other words, both the first and second locking mechanisms must be moved to its unlocking position for the lid 10 to be moved from the closed position to the open position. Although the button plate 212 of the second locking mechanism is described herein as being pivoted on the cover 16, it may be contemplated that the plate 212 is pivoted on the body 16 of the lid 10 for releasably securing the cover 16 of the lid 10 to the body 12 of the lid 10.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

What is claimed is:

1. A lid for use with a drinking vessel containing a liquid, comprising:

a body selectively couplable to the drinking vessel, the body having a drink opening configured to permit fluid passage therethrough when the lid is coupled to the drinking vessel;

a drink opening stopper operable to transition between a closed position whereat the drink opening stopper is positioned at the drink opening to prevent the passage of fluid from within the drinking vessel through the drink opening, and an opened position whereat the drink opening stopper is positioned away from the drink opening to permit the passage of fluid from within the drinking vessel through the drink opening;

a lock actuator rotatably attached to the body for rotation about a lock actuator axis of rotation between a locking position and an unlocking position; and a locking member rotatably attached to the body for rotation about a locking member axis of rotation and rotatably movable about the locking member axis of rotation in response to rotation of the lock actuator about the lock actuator axis of rotation, when the lock actuator is rotated to the locking position, the locking member prevents the drink opening stopper from transitioning from the closed position to the opened position, and when the lock actuator is rotated to the unlocking position, the locking member permits the drink opening stopper to transition from the closed position to the opened position.

2. The lid of claim 1, further including a button inwardly movable in response to an inwardly directed actuation force applied directly to the button when the lock actuator is rotated to the locking position, inward movement of the button permitting movement of the drink opening stopper from the closed position to the open position.

3. The lid of claim 1, wherein the lock actuator is in engagement with the locking member to provide rotational drive to the locking member for rotational movement of the locking member about the locking member axis of rotation between a lock position and an unlock position, when in the lock position the locking member prevents the drink opening stopper from transitioning from the closed position to the opened position, and when in the unlocked position the locking member permits the drink opening stopper to transition from the closed position to the opened position.

4. The lid of claim 3, wherein the lock actuator is rotatable about the lock actuator axis of rotation between the locking and unlocking positions within a first horizontal plane of rotation.

5. The lid of claim 4, wherein the locking member is rotatable about the locking member axis of rotation between the lock and unlock positions within a second horizontal plane of rotation.

6. The lid of claim 5, wherein the second horizontal plane of rotation is below the first horizontal plane of rotation.

7. The lid of claim 1, wherein the lock actuator is rotatable about the lock actuator axis of rotation within a first horizontal plane of rotation.

8. The lid of claim 7, wherein the locking member is rotatable about the locking member axis of rotation in a second horizontal plane of rotation.

9. The lid of claim 8, wherein the second horizontal plane of rotation is below the first horizontal plan of rotation.

10. The lid of claim 1, wherein the locking member axis of rotation is a vertical axis of the body of the lid.

11. The lid of claim 10, wherein the lock actuator axis of rotation is the vertical axis of the body of the lid.

12. The lid of claim 1, wherein the body has an upper end portion to which the lock actuator is rotatably attached.

13. The lid of claim 1, wherein the lock actuator has an outer perimeter portion with at least a portion thereof having a circular shape.

14. The lid of claim 1, wherein when the lock actuator is in the locking position, the lock actuator extends over and covers the drink opening.

15. The lid of claim 1, wherein the lock actuator is rotatable with a circular movement between the locking position and the unlocking position.

16. The lid of claim 1, wherein the locking member is rotatable about the locking member axis with a circular movement.

17. The lid of claim 1, wherein rotation of the lock actuator between the locking position and the unlocking position rotates the locking member with a circular movement between a lock position and an unlock position, when in the lock position the drink opening is closed by the drink opening stopper to prevent the passage of fluid from within the drinking vessel through the drink opening, and when in the unlock position the drink opening is opened by the drink opening stopper to permit the passage of fluid from within the drinking vessel through the drink opening.

18. The lid of claim 1, wherein rotation of the lock actuator is restricted to rotation between the locking position and the unlocking position, and wherein a first stop prevents rotation of the lock actuator beyond the locking position when being rotated from the unlocking position to the locking position, and a second stop prevents rotation of the lock actuator beyond the unlocking position when being rotated from the locking position to the unlocking position.

19. The lid of claim 1, further including first and second retainer portions, the first retainer portion being positioned and configured to apply a first retention force to the lock actuator to retain the lock actuator in the locking position until a larger force is applied to the lock actuator to move the lock actuator toward the unlocking position, and the second retainer portion being positioned and configured to apply a second retention force to the lock actuator to retain the lock actuator in the unlocking position until a larger force is applied to the lock actuator to move the lock actuator toward the locking position.

20. The lid of claim 1, further including a cover rotatably coupled to the body and operative to rotatably transition between a closed position wherein the cover is engaged with the body and an open position wherein the cover is spaced apart from the body, and wherein the drink opening stopper is attached to the cover for movement therewith.

21. The lid of claim 20, wherein the lock actuator is rotatably attached to the cover.

22. The lid of claim 21, further including a locking mechanism holding the cover in the closed position and operable to permit transition of the cover from the closed position to the open position.

23. A lid for use with a drinking vessel containing a liquid, comprising:

a body selectively couplable to the drinking vessel, the body having a drink opening configured to permit fluid passage therethrough when the lid is coupled to the drinking vessel;

a drink opening stopper operable to transition between a closed position whereat the drink opening stopper is positioned at the drink opening to prevent the passage of fluid from within the drinking vessel through the drink opening, and an opened position whereat the drink opening stopper is positioned away from the drink opening to permit the passage of fluid from within the drinking vessel through the drink opening;

a manually rotatable lock actuator;

a locking member rotatable between a lock position and an unlock position, the lock actuator being engagable with the locking member to provide rotational drive to the locking member to move the locking member from the locked position to the unlock position, whereat the locking member permits the drink opening stopper to transition from the closed position to the opened position; and a drink opening stopper actuator movable in response to an actuation force applied thereto when the locking member is in the unlock position, actuating movement of the drink opening stopper actuator permitting movement of the drink opening stopper from the closed position to the open position.

24. The lid of claim 23, wherein the drink opening stopper actuator is a button inwardly movable in response to an inwardly directed actuation force applied directly to the button when the locking member is in the unlock position, inward movement of the button permitting movement of the drink opening stopper from the closed position to the open position.

25. A lid for use with a drinking vessel containing a liquid, comprising:

a body selectively couplable to the drinking vessel, the body having a drink opening configured to permit fluid passage therethrough when the lid is coupled to the drinking vessel;

a drink opening stopper operable to transition between a closed position whereat the drink opening stopper is positioned at the drink opening to prevent the passage of fluid from within the drinking vessel through the drink opening, and an opened position whereat the drink opening stopper is positioned away from the drink opening to permit the passage of fluid from within the drinking vessel through the drink opening;

a manually rotatable lock actuator selectively movable by a user in first and second rotational directions;

a locking member rotatable between a lock position and an unlock position, the lock actuator being engagable with the locking member to provide rotational drive to the locking member, rotation of the lock actuator in the first rotational direction rotating the locking member to the lock position whereat the locking member prevents the drink opening stopper from transitioning from the closed position to the opened position, and rotation of the lock actuator in the second rotational direction rotating the locking member to the unlock position whereat the locking member permits the drink opening stopper to transition from the closed position to the opened position; and a drink opening stopper actuator movable in response to an actuation force applied thereto when the locking member is in the unlock position, actuating movement of the drink opening stopper actuator permitting movement of the drink opening stopper from the closed position to the open position.

26. The lid of claim 25, wherein the drink opening stopper actuator is a button inwardly movable in response to an inwardly directed actuation force applied directly to the button when the locking member to the unlock position, inward movement of the button permitting movement of the drink opening stopper from the closed position to the open position.

* * * * *